US011707643B2

(12) United States Patent
Lagree et al.

(10) Patent No.: US 11,707,643 B2
(45) **Date of Patent: *Jul. 25, 2023**

(54) EXERCISE MACHINE WITH LEVITATED PLATFORM

(71) Applicant: Lagree Technologies, Inc., Chatsworth, CA (US)

(72) Inventors: Sebastien Anthony Louis Lagree, Chatsworth, CA (US); Mirko Pafundi, Asti (IT); Andy H. Gibbs, Oro Valley, AZ (US)

(73) Assignee: Lagree Technologies, Inc., Chatsworth, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/986,567

(22) Filed: Nov. 14, 2022

(65) Prior Publication Data

US 2023/0072936 A1 Mar. 9, 2023

Related U.S. Application Data

(63) Continuation of application No. 17/313,465, filed on May 6, 2021, now Pat. No. 11,504,573, which is a (Continued)

(51) Int. Cl.
*A63B 22/00* (2006.01)
*A63B 21/005* (2006.01)
(Continued)

(52) U.S. Cl.
CPC ..... *A63B 22/0087* (2013.01); *A63B 21/0051* (2013.01); *A63B 21/005* (2013.01); *A63B 21/0052* (2013.01); *A63B 21/023* (2013.01); *A63B 21/4033* (2015.10); *A63B 21/4045* (2015.10); *A63B 22/0089* (2013.01); *A63B 2209/08* (2013.01)

(58) Field of Classification Search
None
See application file for complete search history.

(56) References Cited

U.S. PATENT DOCUMENTS 1,621,477 A 3/1927 Pilates
3,770,267 A 11/1973 McCarthy
(Continued)

FOREIGN PATENT DOCUMENTS

WO 2004/096376 A1 11/2004

*Primary Examiner* — Joshua Lee
(74) *Attorney, Agent, or Firm* — Neustel Law Offices

(57) ABSTRACT

An improved exercise machine has a stationary longitudinal monorail structure that extends between front and back end stationary exercise platforms, and an exercise platform mounted on a levitated carriage that is reciprocally movable along the monorail between the stationary platforms. Magnetic elements arranged on various opposing surfaces of the carriage and monorail generate magnetic forces that levitate and stabilize the carriage as it moves relative to the monorail thus substantially eliminating contact friction. Springs selectively attachable to the movable platform provide a resistance force for exercising. Pseudo-levitation and eddy brake elements on the carriage and monorail structure further stabilize the carriage and platform.

20 Claims, 13 Drawing Sheets

Related U.S. Application Data continuation of application No. 16/545,063, filed on Aug. 20, 2019, now Pat. No. 11,000,727.

(60) Provisional application No. 62/719,837, filed on Aug. 20, 2018.

(51) Int. Cl.
*A63B 21/02* (2006.01)
*A63B 21/00* (2006.01)

(56) References Cited

U.S. PATENT DOCUMENTS 4,759,540 A 7/1988 Yu
4,798,378 A 1/1989 Jones
5,066,005 A 11/1991 Luecke
5,263,913 A 11/1993 Boren
D362,700 S 9/1995 Breibart
D382,319 S 8/1997 Gerschefske
5,681,249 A 10/1997 Endelman
5,885,197 A 3/1999 Barton
5,967,955 A 10/1999 Westfall
6,179,753 B1 1/2001 Barker
7,163,500 B2 1/2007 Endelman
7,803,095 B1 9/2010 Lagree
7,931,570 B2 4/2011 Hoffman
8,249,714 B1 8/2012 Hartman
8,585,554 B2 11/2013 Shavit
8,894,551 B2 * 11/2014 Kerdjoudj ..... A63B 21/0557 482/70
10,046,193 B1 8/2018 Aronson
2001/0056011 A1 12/2001 Endelman
2003/0119635 A1 6/2003 Arbuckle
2005/0130810 A1 6/2005 Sands
2005/0164856 A1 7/2005 Parmater
2006/0046914 A1 3/2006 Endelman
2006/0199712 A1 9/2006 Barnard
2007/0087921 A1 4/2007 Graham
2008/0070765 A1 3/2008 Brown
2008/0248935 A1 10/2008 Solow
2010/0227748 A1 9/2010 Campanaro
2011/0009249 A1 1/2011 Campanaro
2011/0143898 A1 6/2011 Trees
2011/0166002 A1 7/2011 Savsek
2011/0172069 A1 7/2011 Gerschefske
2012/0295771 A1 11/2012 Lagree
2013/0017935 A1 1/2013 Endelman
2013/0196835 A1 8/2013 Solow
2013/0237393 A1 * 9/2013 Kerdjoudj ..... A63B 21/4033 482/122
2014/0011645 A1 1/2014 Johnson
2014/0100089 A1 4/2014 Kermath
2014/0121076 A1 5/2014 Lagree
2014/0121078 A1 5/2014 Lagree
2014/0121079 A1 5/2014 Lagree
2014/0141948 A1 5/2014 Aronson
2015/0024914 A1 1/2015 Lagree
2015/0057127 A1 2/2015 Lagree
2015/0065318 A1 3/2015 Lagree
2015/0072841 A1 3/2015 Lagree
2015/0141204 A1 5/2015 Lagree
2015/0217164 A1 8/2015 Lagree
2015/0220523 A1 8/2015 Lagree
2015/0246263 A1 9/2015 Campanaro
2015/0297944 A1 10/2015 Lagree
2015/0343250 A1 12/2015 Lagree
2015/0360068 A1 12/2015 Lagree
2015/0360083 A1 12/2015 Lagree
2015/0360113 A1 12/2015 Lagree
2015/0364058 A1 12/2015 Lagree
2015/0367166 A1 12/2015 Lagree
2016/0008657 A1 1/2016 Lagree
2016/0059060 A1 3/2016 Lagree
2016/0059061 A1 3/2016 Lagree
2016/0096059 A1 4/2016 Lagree
2016/0166870 A1 6/2016 Lagree
2016/0193496 A1 7/2016 Lagree
2016/0256733 A1 9/2016 Lagree
2016/0271452 A1 9/2016 Lagree
2016/0317858 A1 11/2016 Lagree
2016/0346593 A1 12/2016 Lagree
2016/0361602 A1 12/2016 Lagree
2017/0014664 A1 1/2017 Lagree
2017/0014672 A1 1/2017 Lagree
2017/0036057 A1 2/2017 Lagree
2017/0036061 A1 2/2017 Lagree
2017/0065846 A1 3/2017 Lagree
2017/0072252 A1 3/2017 Lagree
2017/0087397 A1 3/2017 Lagree
2017/0100625 A1 4/2017 Lagree
2017/0100629 A1 4/2017 Lagree
2017/0106232 A1 4/2017 Lagree
2017/0113091 A1 4/2017 Lagree
2017/0120101 A1 5/2017 Lagree
2017/0144013 A1 5/2017 Lagree
2017/0157452 A1 6/2017 Lagree
2017/0157458 A1 6/2017 Lagree
2017/0165518 A1 6/2017 Lagree
2017/0165555 A1 6/2017 Lagree
2017/0189740 A1 7/2017 Lagree
2017/0189741 A1 7/2017 Lagree
2017/0209728 A1 7/2017 Lagree
2017/0239526 A1 8/2017 Lagree
2017/0246491 A1 8/2017 Lagree
2017/0246499 A1 8/2017 Lagree
2017/0296865 A1 10/2017 Lagree
2017/0304673 A1 10/2017 Lagree
2017/0326406 A1 11/2017 Lagree
2017/0340947 A1 11/2017 Lagree
2017/0354840 A1 12/2017 Lagree
2018/0015319 A1 * 1/2018 Lagree ..... A63B 21/0442
2018/0021621 A1 1/2018 Lagree
2018/0021655 A1 1/2018 Lagree
2018/0036583 A1 2/2018 Lagree
2018/0056109 A1 3/2018 Lagree
2018/0056133 A1 3/2018 Lagree
2018/0111020 A1 4/2018 Lagree
2018/0111033 A1 4/2018 Lagree
2018/0117392 A1 5/2018 Lagree
2018/0133532 A1 5/2018 Lagree
2018/0133533 A1 5/2018 Lagree
2018/0133534 A1 5/2018 Lagree
2018/0133542 A1 5/2018 Lagree
2018/0178053 A1 6/2018 Lagree
2018/0193691 A1 7/2018 Lagree
2018/0250551 A1 9/2018 Lagree
2018/0250573 A1 9/2018 Lagree
2018/0272179 A1 9/2018 Lagree
2018/0280782 A1 10/2018 Lagree
2018/0318627 A1 11/2018 Lagree
2018/0318646 A1 11/2018 Lagree
2018/0326252 A1 11/2018 Lagree
2018/0353803 A1 12/2018 Lagree
2018/0361190 A1 12/2018 Lagree
2018/0361197 A1 12/2018 Lagree
2019/0083842 A1 3/2019 Lagree
2019/0160320 A1 5/2019 Lagree
2019/0160329 A1 5/2019 Lagree
2019/0232105 A1 8/2019 Lagree
2019/0240530 A1 8/2019 Lagree
2019/0247694 A1 8/2019 Lagree
2019/0247705 A1 8/2019 Lagree
2019/0247707 A1 8/2019 Lagree
2020/0222741 A1 7/2020 Aronson

* cited by examiner

EXERCISE MACHINE WITH LEVITATED PLATFORM

CROSS REFERENCE TO RELATED APPLICATIONS

The present application is a continuation of U.S. application Ser. No. 17/313,465 filed on May 6, 2021 which issues on Nov. 22, 2022 as U.S. Pat. No. 11,504,573, which is a continuation of U.S. application Ser. No. 16/545,063 filed on Aug. 20, 2019 now issued as U.S. Pat. No. 11,000,727, which claims priority to U.S. Provisional Application No. 62/719,837 filed Aug. 20, 2018. Each of the aforementioned patent applications is herein incorporated by reference in their entirety.

STATEMENT REGARDING FEDERALLY SPONSORED RESEARCH OR DEVELOPMENT

Not applicable to this application.

BACKGROUND

Field

Example embodiments in general relate to the field of sports and fitness training and exercising equipment. More specifically, example embodiments relate to a machine equipped for resistance training or exercise with a magnetically levitated movable exercise platform.

Related Art

Any discussion of the related art throughout the specification should in no way be considered as an admission that such related art is widely known or forms part of common general knowledge in the field.

There are a variety of different designs for exercise machines and apparatuses for muscular strength and cardiovascular training and exercise by exercisers. Some exercise machines and apparatuses may provide for a fixed or adjustable amount of resistance to be used during exercise sessions to enhance the muscle strength of exercisers. Such machines and apparatuses may incorporate as resistance sources free weights, such as barbells, dumbbells or stacked weights, or resistance springs or bands. Alternatively or in addition, a machine or apparatus may be arranged so that an exerciser is positioned in such a way that the exerciser's own body weight provides a weight-based resistance source.

An exercise machine or apparatus for strength training may incorporate a movable portion with a substantially horizontal surface or platform upon which an exerciser can sit or stand during exercise. The movable portion or the exerciser may be connected to a resistance inducing source arranged to oppose movement of the movable portion and the exerciser to enhance the muscular effort required by the exerciser to move the movable portion during exercise.

For instance, on a rowing machine apparatus, an exerciser may sit upon a substantially horizontal seat adapted to freely slide along a stationary longitudinal rail. The exerciser may grasp a resistance inducing component of the machine with their hands and pull against it to move the seat during exercise. The seat may move along a length of the longitudinal rail upon wheels to reduce the friction between the rail and seat.

In another example, a Pilates machine may provide a substantially horizontal platform that slides along one or more stationary longitudinal rails. The platform may be movably connected to one end of one or more resistance-inducing means, such as springs or elastic bands, the other ends of which are connected to a stationary portion of the machine. An exerciser may position a part of the exerciser's body on the platform and exert muscular force against the force of the resistance-inducing means to cause the platform to move along the rail or rails during exercise. The Pilates platform may move along a length of the longitudinal rail or rails upon wheels to reduce the friction between the seat and the rails.

In machines and apparatuses of the type described above, regardless of the use of wheels or other means intended to reduce friction between the movable platform and stationary rail components, there always remains a level of friction due to contact between the movable and stationary components. This undesired friction may be experienced by an exerciser and may interfere with the exerciser's use and enjoyment of the machine. In addition, the undesired friction adds an unknown level of resistance to the known level of resistance set on the machine by an exerciser or trainer and against which the exerciser intends to work during exercise. The additional resistance may interfere with the proper performance of exercises by an exerciser and may impair the results desired to be achieved from the exercises. It would thus be desirable to greatly reduce or eliminate the additional and undesired friction between the movable platform and stationary rail components of such machines and apparatuses while retaining the benefits obtainable from using the relative movement between the moving platform and stationary rail components during the performance of resistance training and exercise regimens.

One approach to eliminate friction due to physical contact between such moving and stationary components is to use a repelling magnetic force. Magnets have been applied to levitation, propulsion and eddy brake damping in connection with high speed, long distance vehicles such as bullet trains, monorail vehicles, and theoretical space launch platforms. However, the magnetic levitation systems involved in those applications are high-powered, highly complex, and extremely expensive. It is not economically or technically feasible or suitable to use such systems in connection with exercise and training machines and apparatuses of the type described herein in which the movable components move under forces supplied by exercisers, at low speed, over only very short distances, and in a repeated and reciprocal manner.

There thus remains a need for an exercise and training machine or apparatus of the type described herein with a levitated movable carriage and platform that greatly reduces or eliminates friction and additional resistance between the movable platform and stationary rail components of the machine or apparatus.

SUMMARY

Example embodiments are directed to an improved exercise machine with a magnetically levitated carriage and platform that are movable along a stationary rail structure for performing resistance training and exercises.

An example exercise machine is a generally elongated structure generally comprising an upper frame and a base. The upper frame generally comprises a substantially longitudinal stationary rail structure, front end and back end stationary exercise platforms, and a movable carriage and exercise platform that is reciprocally movable longitudinally along the rail structure between the stationary platforms. A resistance force-inducing component is selectably connectable to the movable carriage and platform and provides a selectable level of resistance force for resistance training or exercise. The base generally comprises a support base and a plurality of actuators that support the upper frame on the base and are operable to raise and lower the front and back ends of the upper frame.

The movable carriage and platform are levitated relative to the stationary rail structure by magnetic forces generated by an arrangement of magnetic elements on opposing adjacent surfaces of the carriage and the rail structure. Preferably, the magnetic elements are arranged so that the movable carriage and platform are levitated and have substantially no contact with the stationary rail structure over substantially the entire length the movable platform is intended to travel between the stationary platforms, thus substantially eliminating contact friction and additional resistance when the platform is moved relative to the rail structure.

In one exemplary embodiment, a first set of magnetic elements is positioned substantially opposite and facing each other on opposed lower adjacent surfaces of the movable carriage and the stationary rail structure to produce a levitation force on the carriage and platform. A second set of magnetic elements is positioned substantially opposite and facing each other on opposed upper adjacent surfaces of the movable carriage and the stationary rail structure to produce a preload force on the movable carriage and platform. The preload and levitation forces are balanced to effectively levitate the movable platform relative to the stationary rail structure.

In some embodiments of an example machine, a plurality of pseudo-levitation elements comprising low friction roller bearings is arranged on various surfaces of the movable carriage and platform. The rollers are adapted to stabilize the carriage and platform by providing low friction rolling contact between adjacent opposed surfaces of the movable carriage and the stationary rail structure in response to vertical and/or lateral forces on the platform that are sufficient to overcome the magnetic levitation forces and cause the adjacent opposed surfaces to come into contact.

In some embodiments of an example machine, one or more eddy brake elements may be mounted on opposed adjacent surfaces of the movable carriage and stationary rail structure. The provision of the eddy brake elements helps stabilize the movable carriage and platform and dampen vibrations as the levitated carriage and platform move along the rail structure.

There has thus been outlined, rather broadly, some of the embodiments of an improved exercise machine with a magnetically levitated movable carriage and platform in order that the detailed description thereof may be better understood, and in order that the present contribution to the art may be better appreciated. Additional embodiments of the exercise machine will be described hereinafter and will form the subject matter of the claims appended hereto. In this respect, before explaining at least one embodiment of the exercise machine in detail, it is to be understood that the exercise machine is not limited in its application to the details of construction or to the arrangements of the components set forth in the following description or illustrated in the drawings. The exercise machine is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Figure 1:
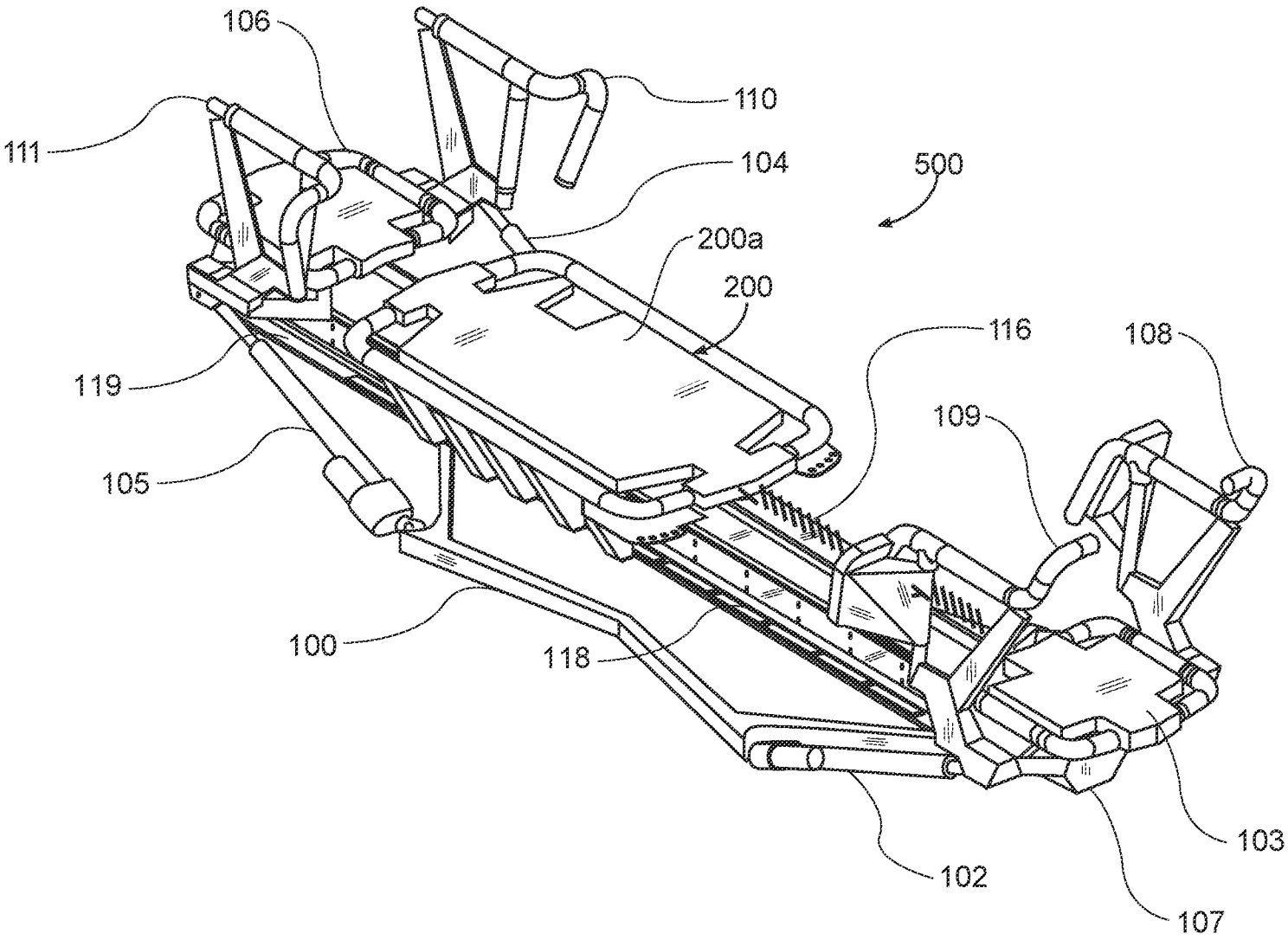
FIG. 1 is a top isometric view of an improved exercise machine with a levitated movable carriage and platform in accordance with an example embodiment.

Various aspects of specific embodiments are disclosed in the following description and related drawings. Alternate embodiments may be devised without departing from the spirit or the scope of the present disclosure. Additionally, well-known elements of exemplary embodiments will not be described in detail or will be omitted so as not to obscure relevant details. Further, to facilitate an understanding of the description, a discussion of several terms used herein follows.

The word "exemplary" is used herein to mean "serving as an example, instance, or illustration." Any embodiment described herein as "exemplary" is not necessarily to be construed as preferred or advantageous over other embodiments. Likewise, the term "embodiments" is not exhaustive and does not require that all embodiments include the discussed feature, advantage or mode of operation.

The word "magnet," the phrase "magnetic element," and variations thereof as used herein include permanent magnets such as ferromagnetic metal, composite, and rare earth magnets, superconductor magnets, electromagnets and/or magnet arrays such as Halbach arrays. Further, any other types of magnets and magnetic elements that are reasonably capable of achieving the functions and objectives described herein are intended to be encompassed as well, and it is to be understood that any or all of these may be used without departing from the intended scope of the described embodiments.

Wherever the polarity or poles of opposed adjacent magnets or magnetic elements are described as being the same or common so as to generate repelling forces, it is understood that the same or common poles may be either the N or S pole, and further that the magnets may be reoriented so that the common or same poles are the opposite pole (S or N) without departing from the intended scope of the described embodiments. Similarly, wherever the polarity or poles of opposed adjacent magnets or magnetic elements are described as being opposite so as generate attractive forces, it is understood that either magnet may be oriented to present the N or S pole and the other magnet may be oriented to present the opposite S or N pole without departing from the intended scope of the described embodiments Further, wherever the levitation of the movable carriage is described as being maintained by an arrangement of opposed magnetic elements on both lateral sides of the stationary rail structure and both lateral sides of the carriage with the opposed magnetic elements being oriented to have the same or common polarity to maximize repulsive forces, it is to be understood that the opposed magnetic elements alternatively may be oriented to have the opposite polarity to maximize magnetic attractive forces, the reversing of polarity having no substantial difference in function or effect with respect to the levitation of the structure.

The phrase "monorail structure" as used herein means an elongated structure with rails positioned approximately parallel to, but approximately equidistant from the centerline of the levitated movable carriage as measured along the transverse axis of the exercise machine, the rails preferably extending substantially the length of the machine. However, a multiple rail structure such as substantially parallel longitudinal rails may be used in place of a single central monorail structure with no substantial difference in function or effect. Thus, the more general phrase "rail structure" may be used herein interchangeably and it is understood that the embodiments as described herein are intended to encompass other substantially longitudinal rail structures that are consistent with achieving the functions and objectives described herein.

The term "actuator" is used herein to mean a device operable to cause a first element of an exercise machine to move relative to a second element by means of moving a first portion of the actuator relative to a second stationary portion of the actuator where the first and second portions of the actuator are affixed to the first and second elements of the exercise machine respectively. The motion of the actuator first portion relative to the second portion may be extension/retraction, rotation, or any other relative motion. The particular "linear" actuators described in connection with the example embodiments described below are not intended to be limiting. Rather, one or more types of linear and other actuators well known to those skilled in the art may be used including, but not limited to mechanical, pneumatic, hydraulic, or electromechanical actuators.

References to "front," "back," "left," "right," "top," "bottom," "upper," and "lower" with respect to example exercise machine embodiments and/or various components thereof described herein are used relatively and for convenience of description only and are not meant to be limiting. Thus, it is understood for example that either longitudinal end of a described example exercise machine may be considered the front end or the back end of the machine, that either lateral side of the machine may be considered the left or right side, and that either surface or extent of a component of the machine may be the top or bottom or upper or lower.

Although more than one embodiment may be illustrated and described herein, it will be appreciated by those of ordinary skill in the art that a wide variety of alternate and/or equivalent implementations may be substituted for the specific embodiments shown and described without departing from the scope of the present disclosure. This application is intended to cover any adaptations or variations of the embodiments discussed herein, including any combinations of embodiments or portions thereof, that are not inconsistent with achieving the functions and objectives identified herein.

A. Overview

An example embodiment of an exercise machine 500 may comprise a base 100 and an upper frame 118 having at least one track 119, a first end and a second end opposite the first end, wherein the upper frame 118 includes a longitudinal axis and wherein the at least one track 119 has a longitudinal axis, wherein the at least one track 119 comprises a monorail 107 including a first side and a second side. A movable carriage 200 including a platform 200*a* is adapted to move along the monorail 107, the movable carriage 200 being magnetically levitated with respect to the monorail 107.

A first upper magnetic rail 203 is connected to the monorail 107 and a first upper carriage magnet 204 is connected to the movable carriage 200, wherein the first upper carriage magnet 204 is aligned with the first upper magnetic rail 203 such that a first preloading force is imparted between the first upper carriage magnet 204 and the first upper magnetic rail 203. A second upper magnetic rail 203-1 is connected to the monorail 107 and a second upper carriage magnet 204-1 is connected to the movable carriage 200, wherein the second upper carriage magnet 204-1 is aligned with the second upper magnetic rail 203-1 such that a second preloading force is imparted between the second upper carriage magnet 204-1 and the second upper magnetic rail 203-1.

A first lower magnetic rail 205 is connected to the monorail 107 and a first lower carriage magnet 206 is connected to the movable carriage 200, wherein the first lower carriage magnet 206 is aligned with the first lower magnetic rail 205 such that a first lifting force is imparted between the first lower carriage magnet 206 and the first lower magnetic rail 205. A second lower magnetic rail 205-1 is connected to the monorail 107 and a second lower carriage magnet 206-1 is connected to the movable carriage 200, wherein the second lower carriage magnet 206-1 is aligned with the second lower magnetic rail 205-1 such that a second lifting force is imparted between the second lower carriage magnet 206-1 and the second lower magnetic rail 205-1.

The first upper carriage magnet 204, the second upper carriage magnet 204-1, the first lower carriage magnet 206, and the second lower carriage magnet 206-1 may each comprise a magnetic flux concentrator 211 for concentrating magnetic flux. The first upper magnetic rail 203, second upper magnetic rail 203-1, first lower magnetic rail 205, and second lower magnetic rail 205-1 may each comprise one or more magnetic elements 209. The one or more magnetic elements 209 may each comprise a magnetic flux concentrator 211 for concentrating magnetic flux.

The movable carriage 200 may comprise a first undercarriage 201, wherein the first upper carriage magnet 204 and the first lower carriage magnet 206 are each connected to the first undercarriage 201. The movable carriage 200 may comprise a second undercarriage 202, wherein the second upper carriage magnet 204-1 and the second lower carriage magnet 206-1 are each connected to the second undercarriage 202.

The first undercarriage 201 may extend between the first upper magnetic rail 203 and the first lower magnetic rail 205 such that the first upper carriage magnet 204 faces the first upper magnetic rail 203 and the first lower carriage magnet 206 faces the first lower magnetic rail 205. The second undercarriage 202 may extend between the second upper magnetic rail 203-1 and the second lower magnetic rail 205-1 such that the second upper carriage magnet 204-1 faces the second upper magnetic rail 203-1 and the second lower carriage magnet 206-1 faces the second lower magnetic rail 205-1. The first upper magnetic rail 203 and the first lower magnetic rail 205 may each be on the first side 307 of the monorail 107 and the second upper magnetic rail 203-1 and the second lower magnetic rail 205-1 may each be on the second side 308 of the monorail 107.

The first side 307 of the monorail 107 includes a first braking rail 208, wherein the carriage 200 comprises a first brake magnet 207 facing the first braking rail 208. The second side 308 of the monorail 107 includes a second braking rail 208-1, wherein the carriage 200 comprises a second brake magnet 207-1 facing the second braking rail 208-1. The first braking rail 208 and the second braking rail 208-1 may each comprise a non-ferrous material.

The first braking magnet 207 and the second braking magnet 207-1 are each adjustable with respect to the carriage 200. The first braking magnet 207 is flux concentrated by a first flux concentrator 211 and the second braking magnet 207-1 is flux concentrated by a second flux concentrator 211. The first flux concentrator 211 and the second flux concentrator 211 are each comprised of a magnetodielectric material.

Another exemplary exercise machine 500 may comprise a base 100 and an upper frame 118 having at least one track 119, a first end and a second end opposite the first end, wherein the at least one track 119 comprises a monorail 107 including a first side and a second side. A movable carriage 200 is adapted to move along the monorail 107, the movable carriage 200 being magnetically levitated with respect to the monorail 107, wherein the movable carriage 200 comprises a first undercarriage 201 facing the first side 307 of the monorail 107 and a second undercarriage 202 facing the second side 308 of the monorail 107.

A first upper magnetic rail 203 is connected to the monorail 107 and a first upper carriage magnet 204 is connected to the first undercarriage 201 of the movable carriage 200, wherein the first upper carriage magnet 204 is aligned with the first upper magnetic rail 203 such that a first preloading force is imparted between the first upper carriage magnet 204 and the first upper magnetic rail 203.

A second upper magnetic rail 203-1 is connected to the monorail 107 and a second upper carriage magnet 204-1 is connected to the second undercarriage 202 of the movable carriage 200, wherein the second upper carriage magnet 204-1 is aligned with the second upper magnetic rail 203-1 such that a second preloading force is imparted between the second upper carriage magnet 204-1 and the second upper magnetic rail 203-1.

A first lower magnetic rail 205 is connected to the monorail 107 and a first lower carriage magnet 206 is connected to the first undercarriage 201 of the movable carriage 200, wherein the first lower carriage magnet 206 is aligned with the first lower magnetic rail 205 such that a first lifting force is imparted between the first lower carriage magnet 206 and the first lower magnetic rail 205.

A second lower magnetic rail 205-1 is connected to the monorail 107 and a second lower carriage magnet 206-1 is connected to the second undercarriage 202 of the movable carriage 200, wherein the second lower carriage magnet 206-1 is aligned with the second lower magnetic rail 205-1 such that a second lifting force is imparted between the second lower carriage magnet 206-1 and the second lower magnetic rail 205-1.

A first anti-torsion roller 214 connected to the first undercarriage 201 facing the first side 307 of the monorail 107 and a second anti-torsion roller 214 is connected to the second undercarriage 202 facing the second side 308 of the monorail 107, wherein the first anti-torsion roller 214 and the second anti-torsion roller 214 each comprise one or more bearings. An anti-torsion rail 213 may extend upwardly from an upper end of the monorail 107. A first anti-torsion bearing 214 may be positioned between the carriage 200 and the monorail 107 on a first side of the anti-torsion rail 213 and a second anti-torsion bearing 214 may be positioned between the carriage 200 and the monorail 107 on a second side of the anti-torsion rail 213.

An example exercise machine 500 generally is an elongated structure comprising an upper frame 118 and a base 100. The upper frame 118 generally comprises a track such as a substantially longitudinal stationary monorail structure 107, a front end stationary exercise platform 103, a back end stationary exercise platforms 106, and a levitated movable carriage 200 and platform 200*a* which is movable reciprocally along the monorail structure 107 between the stationary end platforms 103, 106. One or more resistance springs 116 are selectively and removably connectable between the movable carriage 200 and a stationary component of the machine 500. The resistance springs 116 apply a selectable level of resistance force against movement of the movable carriage 200 along the monorail 107 for resistance training or exercise. The base 100 generally comprises a support base that rests on a floor, ground surface, or other support surface and has two pairs of actuators 101, 102, 104, 105 mounted on the base 100. The actuators 101, 102, 104, 105 support the upper frame 118 at its front and back ends and are operable to elevate, incline, and tilt the front and back ends as desired.

In various example embodiments, arrays of magnetic elements 209 are arranged on various opposed adjacent surfaces of the movable carriage 200 and the stationary monorail structure 107. The magnetic elements 209 are oriented to generate magnetic forces to levitate and stabilize the movable carriage 200 and platform 200*a* with respect to the monorail 107 without substantial contact over substantially the entire length of travel of the movable carriage 200 between the stationary end platforms 103, 106. This substantially eliminates contact friction between the carriage 200 and monorail 107 as the carriage 200 and platform 200*a* is moved during exercise.

In one example arrangement, arrays of magnetic elements 209 are positioned substantially opposite and facing each other on opposed adjacent lower surfaces of the movable carriage 200 and platform 200*a* and the stationary monorail structure 107 to produce a levitation force on the movable carriage 200 and platform 200*a*, and arrays of magnetic elements 209 are positioned substantially opposite and facing each other on opposed adjacent upper surfaces of the movable carriage 200 and the stationary monorail structure 107 to produce a preload force on the movable carriage 200. The preload and levitation forces are balanced to effectively levitate the movable carriage 200 relative to the stationary monorail structure 107.

In one aspect of an example machine, the magnetic elements 209 are mounted in flux concentrators 211. The flux concentrators 211 have openings that expose first poles of adjacent magnetic elements 209 facing each other while enclosing second poles of the magnetic elements 209. The flux concentrators 211 are thus operable to concentrate the magnetic flux 212 in the space between the exposed first poles of the magnetic elements 209 and thus maximize the magnetic force produced between them.

In various example embodiments, a plurality of pseudo-levitation elements comprising low friction roller bearings 214 is positioned on surfaces of the movable carriage 200. The bearings 214 are adapted to provide temporary low friction rolling contact between adjacent opposed surfaces of the movable carriage 200 and the stationary monorail structure 107. The pseudo-levitation elements help stabilize the movable carriage 200 when vertical or lateral forces applied to the carriage 200 are sufficient to overcome the magnetic levitation forces and cause adjacent opposed surfaces of the carriage 200 and the monorail structure 107 to come into contact.

In various example embodiments, one or more eddy brake elements 207 are mounted on opposed adjacent surfaces of the movable carriage 200 and stationary monorail structure 107. The eddy brake elements 207 provide further stability and help dampen vibrations.

B. Upper Frame and Base Elements

Referring primarily to FIG. 1, an example exercise machine 500 is a substantially elongated structure with a longitudinal axis. The machine 500 comprises opposite proximal and distal ends that are spaced apart along the longitudinal axis and that constitute front and back ends of the machine 500. The machine also comprises opposite elongated lateral sides that extend between the front and back ends. The machine generally comprises an upper frame 118 and a base 100.

The upper frame 118 generally comprises a track such as a substantially longitudinal stationary monorail structure 107 that extends in the direction of and parallel to the longitudinal axis and lateral sides of the machine 500 for substantially the entire length of the machine 500. The upper frame 118 also comprises a stationary front end exercise platform 103 mounted at or near the front end of the machine 500, a stationary back end exercise platform 106 mounted at or near the back end of the machine 500, and a movable carriage 200 with a movable exercise platform 200*a*. The movable carriage 200 and exercise platform 200*a* are magnetically levitated relative to the stationary monorail structure 107 and are guided by and reciprocally movable along substantially the length of the monorail structure 107 between the front end platform 103 and back end platform 106. The stationary platforms 103, 106 and movable exercise carriage 200 and platform 200*a* may be arranged substantially in linear alignment along the longitudinal axis of the machine 500 and provide a set of upper exercise surfaces. The upper exercise surfaces also are substantially longitudinally aligned and substantially co-planar to form an exercise plane 300.

In addition to the exercise platforms 103, 106, 200*a*, the upper frame 118 may comprise a plurality of handle assemblies 108, 109, 110, 111. A front right handle assembly 109 and a front left handle assembly 108 may be mounted at or near the front end of the machine 500 on opposite right and left lateral sides in proximity to the front end platform 103. Similarly, a back right handle assembly 111 and a back left handle assembly 110 are may be mounted at or near the back end of the machine 500 on opposite right and left lateral sides in proximity to the back end platform 106.

The upper frame 118 further comprises a resistance force-inducing element such as, for example, one or more resistance springs or bands 116. The resistance springs 116 may be removably connected between the stationary front end platform 103 and the levitated movable carriage 200 and platform 200*a* although the ends of the springs 116 connected to the stationary platform 103 may alternatively be connected to another stationary component of the machine 500. The resistance springs 116 provide an exerciser-selectable resistance biasing force against movement of the carriage 200 and platform 200*a* which the exerciser 400 must overcome by muscular exertion while moving the carriage 200 in a direction away from the front end stationary platform 103. The machine 500 thus provides exercisers 400 with the ability to selectively apply a desired baseline level of resistance force to the movable carriage 200 and platform 200*a* for resistance training or exercise.

The upper frame 118 may be supported on the base 100 of the machine 500 above a floor, ground surface, or other support surface. The base 100 generally comprises a generally elongated support base structure 100 that extends substantially in the general direction of the longitudinal axis of the machine 500. The components making up the support base 100 may be arranged in a common plane. The support base 100 is adapted to rest on and to be supported by a floor, ground surface, or other support surface that is generally substantially horizontal. A plurality of adjustable leveling feet 100*a* (seen in FIG. 2) may be mounted to the support base 100 to enable the support base 100 to be leveled relative to the floor, ground surface, or other support surface and for the machine 500 to be securely supported thereon in a substantially horizontal plane in the event the floor, ground surface, or other support surface is not substantially horizontal or has surface imperfections that interfere with providing level support. Various types of leveling feet 100*a* are readily available and are suitable for this purpose.

The base 100 further comprises a plurality of actuators 101, 102, 104, 105 connected between the support base 100 and the upper frame 118 to support the upper frame 118 and provide the ability to selectively raise and lower the front and back ends of the exercise machine 500 as desired for various exercises or training regimens. The plurality of actuators 101, 102, 104, 105 may include a front right linear actuator 102, a front left linear actuator 101 (not visible in FIG. 1, but visible in FIGS. 5-7), a back right linear actuator 105, and a back left linear actuator 104. Each of the front and back actuators 101, 102, 104, 105 is independently operable to cause the front end and/or the back end of the machine 500 to be raised or lowered, and to be laterally tilted relative to the longitudinal axis of the machine 500, as desired. The actuators 101, 102, 104, 105 may comprise various types and configurations, including but not limited to the linear-type actuators shown in the figures.

Each of the front right, front left, back right, and back left actuators 102, 101, 105, 104 may be pivotably connected at a lower proximal end to the base 100 and pivotably connected at an upper distal end to one of a plurality of yokes 112, 113, 114, 115 mounted to the upper frame 118 at or near the front or back end of the upper frame 118 respectively as described in further detail below. Further, the front and back right actuators 102, 105 may be connected between the base 100 and the upper frame 118 directly opposite and as mirror images of each other on a right lateral side of the base 100. Similarly, the front and back left actuators 101, 104 may be connected between the base 100 and the upper frame 118 directly opposite and as mirror images of each other on an opposite left lateral side of the base 100.

The actuators 101, 102, 104, 105 may be controlled using switches and electrical wiring mounted on the machine 500 itself or by a suitable remote control transmitter and corresponding receiver mounted on the machine 500. Various forms of switches, electrical wiring, and remote transmitters and receivers are commercially available and suitable for this purpose. The switches or remote control may be used by an exerciser 400 or trainer to independently adjust the length of one or more of the actuators 101, 102, 104, 105 so as to alter the exercise plane 300 defined by the stationary and movable exercise platforms 103, 106, 200*a* of the upper frame 118 of the machine 500.

In practice, when an actuator 101, 102, 104, 105 is activated, a linear rod extends from an actuator body, thereby elevating the corresponding yoke 112, 113, 114, 115 and the corresponding corner of the upper frame 118. By actuating both front or both back actuators 101, 102, 104, 105 in unison, the front or back end of the machine 500 can be elevated relative to the other end to create an inclined exercise plane 300. By actuating the front and back actuators 101, 102, 104, 105 on only one lateral side of the machine 500 or by actuating the front and back actuators 101, 102, 104, 105 on both lateral sides to a different extent, the exercise plane 300 can be rotated or tilted about the longitudinal axis of the machine 500 laterally relative to the plane of the support base 100 and the floor, ground surface, or other support surface on which it rests.

Figure 2:
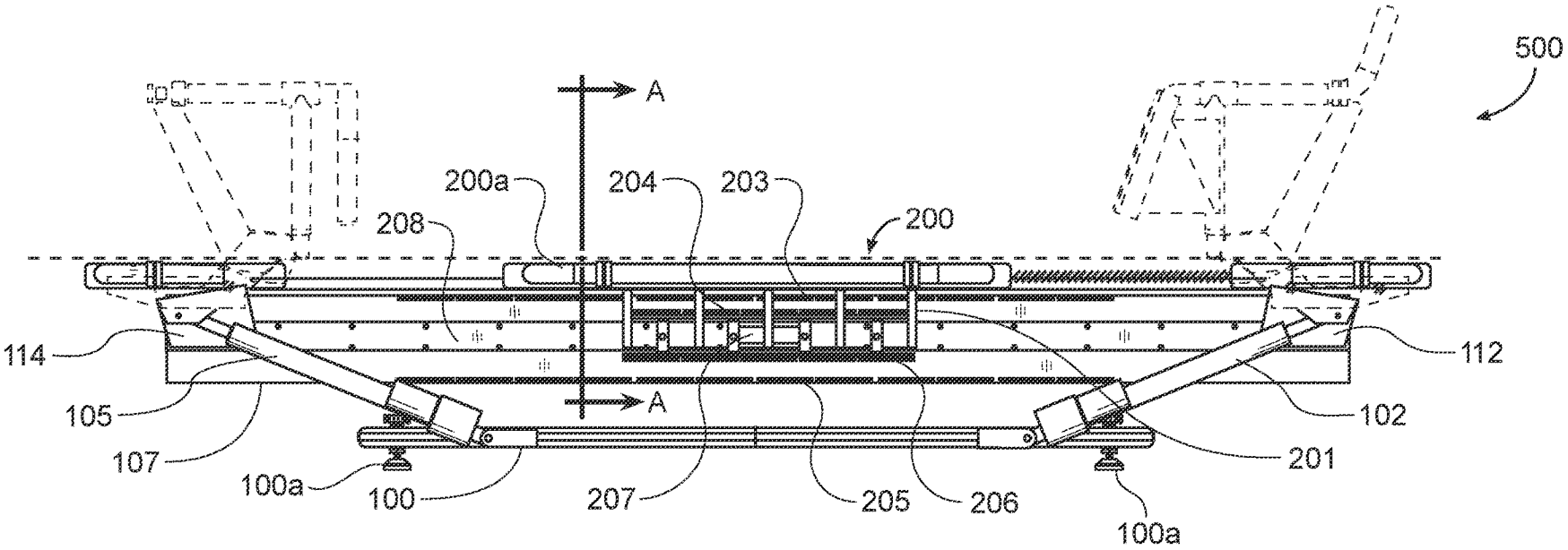
FIG. 2 is a side orthographic view of an improved exercise machine with a levitated movable carriage and platform in accordance with an example embodiment.

Referring primarily to FIG. 2, a side orthographic view of an example improved exercise machine 500 is illustrated with the handle assemblies 108, 109, 110, 111 previously described shown in dashed outlines so as not to obscure other components of the carriage levitation components and systems of the machine 500 described below.

As referred to above, the front right actuator 102, front left actuator 101, back right actuator 105, and back left actuator 104 are pivotably or otherwise movably mounted at their respective lower proximal ends to the base 100, and are pivotably or otherwise movably connected at their respectively upper distal ends to a front right yoke 112, front left yoke 113 (not visible, but visible in FIGS. 5-7) a back right yoke 114, and a back left yoke 115 (not visible, but visible in FIG. 5), each yoke 112, 113, 114, 115 being connected to the upper frame 118 of the machine 500. Thus, the actuators 101, 102, 104, 105 provide the ability to independently and selectably raise and lower one or more corners of the upper frame 118 on opposite lateral sides at or near the front and back ends in response to the actuation of switches and/or a controller to achieve various exercise plane configurations defined by the stationary and movable exercise platforms 103, 106, 200*a*, including those described above.

It should be noted, however, that the improved exercise machine 500 described herein is not intended to be limited to or by any particular form of upper frame 118, including one that may be elevated, tilted or rolled relative to the longitudinal axis of the machine 500 and/or the plane of the support base of the base 100. Thus, the example exercise machine described herein alternatively may incorporate an upper frame 118 that is supported on the base 100 in a fixed plane and without provision for changing that plane. In such an embodiment, actuators 101, 102, 104, 105 may be omitted entirely.

It will be appreciated that by positioning substantially similar magnetic elements 209 spaced along opposed adjacent surfaces of longitudinally-extending parallel rails, magnetic fields and substantially equal repelling (or attractive) magnetic forces can be generated between the opposed rail surfaces. By positioning the rails at substantially equal distances transverse to and along a central longitudinal axis to be traveled by a movable object, the magnetic force can be used to levitate the object. By applying a motive force to the object generally in the direction of the longitudinal axis, the object can be caused to travel along the rails in that direction but with substantially no physical contact between the movable object and the rails and thus substantially no friction or other resistance force resulting from contact impeding the movement of the object.

Thus, and as referred to above, the upper frame 118 comprises a track such as a stationary longitudinal monorail structure 107 with a longitudinal axis that preferably is substantially aligned with and parallel to the longitudinal axis of the machine 500. It should be appreciated that the track may also comprise parallel rails in some embodiments.

The monorail structure 107 may comprise a longitudinal body that extends substantially the length of the machine 500 between the front and back end stationary platforms 103, 106, a pair of right and left longitudinal lower magnetic rails 205, 205-1 affixed to a lower portion of the body, and a pair of right and left longitudinal upper magnetic rails 203, 203-1 affixed to an upper portion of the body. The longitudinal axes of the rails 203, 203-1, 205, 205-1 may be substantially parallel to the longitudinal axis of the monorail 107 body structure. The magnetic rails 203, 203-1, 205, 205-1 may extend longitudinally along the monorail body 107 for substantially the entire length that the movable carriage 200 and platform 200*a* are intended to travel along the monorail 107 between the front end and back end stationary exercise platforms 103, 106. Thus, the magnetic rails 203, 203-1, 205, 205-1 ensure that a magnetic force is applied to levitate the carriage 200 and platform 200*a* over their entire intended path of travel along the monorail 107. As will become clear, while it is illustrated that the magnetic levitating force comprising a magnetic repelling force, configurations of the magnetic rails 203, 203-1, 205, 205-1 and carriage 200 also are contemplated in which magnetic attractive forces may be employed.

Although not visible in FIG. 2 (but visible in FIGS. 6, 7, and 12), the right upper and lower magnetic rails 203, 205 extend laterally outward from the upper and lower portions of the monorail body 107 respectively toward the right lateral side of the machine 500 and the left upper and lower magnetic rails 203-1, 205-1 extend laterally from the upper and lower portions of the monorail 107 body respectively toward the opposite left lateral side of the machine 500. Further, the right and left upper magnetic rails 203, 203-1 may be substantially co-planar and the right and left lower magnetic rails 205, 205-1 may be substantially co-planar. Still further, the right and left upper magnetic rails 203, 203-1 may be positioned substantially opposite each other on the monorail body 107 and the corresponding right and left lower magnetic rails 205, 205-1 may be positioned substantially opposite each other on the monorail body 107. In short, the upper and lower magnetic rails 203-1, 205-1 affixed to and extending laterally from the left side of the monorail body 107 may be identical to and mirror images of the upper and lower magnetic rails 203, 205 affixed to and extending laterally from the right side of the monorail body 107.

The movable exercise platform 200*a* may be mounted atop the magnetically levitated movable carriage 200 and may comprise an upper exercise surface for an exerciser 400 to use in exercise, such as but not limited to exercises involving kneeling, sitting, lying, and/or standing upon the movable exercise platform 200*a*. The carriage 200 comprises a right undercarriage assembly 201 and a left undercarriage assembly 202 (not visible, but visible in FIGS. 6, 7, and 12) that may be mirror images of each other.

The right and left undercarriage assemblies 201, 202 may include upper portions which connect to an undersurface of the exercise platform 200*a* and lateral portions that extend laterally between the right upper and lower magnetic rails 203, 205 and left upper and lower magnetic rails 203-1, 205-1 of the monorail 107, respectively. The left and right undercarriage assemblies 201, 202 may be mounted directly opposite each other near the opposite right and left lateral edges of the platform 200*a* undersurface in order to facilitate lateral balance of the platform 200*a* when the carriage 200 is magnetically levitated. As illustrated, the undercarriage assemblies 201, 202 may extend in the direction of the longitudinal axis of the upper frame 118 for at least a substantial portion of the length of the platform 200*a* to facilitate longitudinal balance of the platform 200*a* when the carriage 200 is magnetically levitated. It will be appreciated however, that the undercarriages 201, 202 may be dimensioned and located relative to the platform 200*a* in any number of different ways that facilitate balance when the carriage 200 is magnetically levitated and it is not intended that the example machine 500 be limited to any specific dimensioning or positioning of the undercarriage assemblies 201, 202 relative to the platform 200*a*. Further, it will be appreciated that while the undercarriage assemblies 201, 202 are illustrated as being integral structures, they can instead comprise several separate longitudinally-spaced structures whether directly interconnected or not.

The right undercarriage assembly 201 may comprise a longitudinal upper carriage rail 204 and a longitudinal lower carriage rail 206. The longitudinal axis of the upper carriage rail 204 is aligned with and parallel to the longitudinal axis of the right upper magnetic rail 203 of the monorail structure 107. The upper carriage rail 204 and right upper magnetic rail 203 have adjacent opposed surfaces that preferably are substantially parallel when the magnetic levitation forces on the movable carriage 200 are substantially balanced. The longitudinal axis of the lower carriage rail 206 is aligned with and parallel to the right lower magnetic rail 205 of the monorail structure. The lower carriage rail 206 and right lower magnetic rail 205 have adjacent opposed surfaces that preferably are substantially parallel when the magnetic levitation forces on the movable carriage are substantially balanced. The upper and lower carriage rails 204, 206 of the right undercarriage assembly 201 move together with the levitated carriage 200 substantially parallel to the longitudinal axes of the stationary right upper and lower magnetic rails 203, 205 and monorail structure 107.

Although not visible in FIG. 2 (but visible in FIG. 12), the left undercarriage assembly 202 is essentially a mirror image of the right undercarriage assembly. The left undercarriage assembly 202 comprises a longitudinal upper carriage rail 204-1 and a longitudinal lower carriage rail 206-1. The longitudinal axis of the upper carriage rail 204-1 is aligned with and parallel to the longitudinal axis of the left upper magnetic rail 203-1 of the monorail structure. The upper carriage rail 204-1 and left upper magnetic rail 203-1 have adjacent opposed surfaces that preferably are substantially parallel when the magnetic levitation forces on the movable carriage 200 are substantially balanced. The longitudinal axis of the lower carriage rail 206-1 is aligned with and parallel to the left lower magnetic rail 205-1 of the monorail structure 107. The lower carriage rail 206-1 and left lower magnetic rail 205-1 have adjacent opposed surfaces that preferably are substantially parallel when the magnetic levitation forces on the movable carriage 200 are substantially balanced. The upper and lower carriage rails 204-1, 206-1 of the left undercarriage assembly 201 move together with the levitated carriage 200 substantially parallel to the longitudinal axes of the stationary left upper and lower magnetic rails 203-1, 205-1 and monorail structure 107.

A longitudinal non-ferrous braking rail 208 is affixed to a substantially vertical right lateral side surface of the monorail structure 107. A substantially identical non-ferrous braking rail 208-1 (not visible, but visible in FIGS. 6, 7, and 12) is affixed in substantially the same position on a directly opposite substantially vertical left lateral side surface of the monorail structure 107. The laterally-extending portion of the right undercarriage assembly 201 comprises a substantially vertical surface adjacent and opposed to the vertical right lateral side surface of the monorail structure 107 on which the non-ferrous braking rail 208 is affixed.

One or more eddy current brake magnets 207 are adjustably affixed to the vertical surface of the right undercarriage assembly 201 adjacent and opposed to the non-ferrous braking rail 208. Similarly, (although not visible in FIG. 2), the laterally-extending portion of the left undercarriage assembly 202 comprises a substantially vertical surface adjacent and opposed to the vertical left lateral side surface of the monorail structure 107 on which the non-ferrous braking rail 208-1 is affixed. One or more eddy current brake magnets 207-1 are adjustably affixed to the vertical surface of the left undercarriage assembly 202 and opposed to the non-ferrous braking rail 208-1. As a result, a braking force is induced and applied against the opposed right and left undercarriage assemblies 201, 202 of the levitated movable carriage 200 relative to the longitudinal axis of the monorail structure 107. The eddy current brake 207 of the example embodiments will be described in more detail below.

The adjustment of the eddy current brake magnets 207, 207-1 allows for variable resistance by increasing or decreasing the braking force being induced. The manner in which the eddy current brake magnets 207, 207-1 are adjustable may vary in different embodiments. In the exemplary embodiment shown in FIG. 12, it can be seen that each of the eddy current brake magnets 207, 207-1 includes an adjustment bolt 304 which extends through a bracket 305 and nut, with the eddy current brake magnets 207, 207-1 being positioned on the distal ends of the adjustment bolts 304. The adjustment bolts 304 may be rotated in a first direction to advance the eddy current brake magnets 207, 207-1 toward the braking rail 208 and in a second direction to retract the eddy current brake magnets 207, 207-1 away from the braking rail 208. In this manner, the induced braking force may be increased or decreased.

Figure 3B:
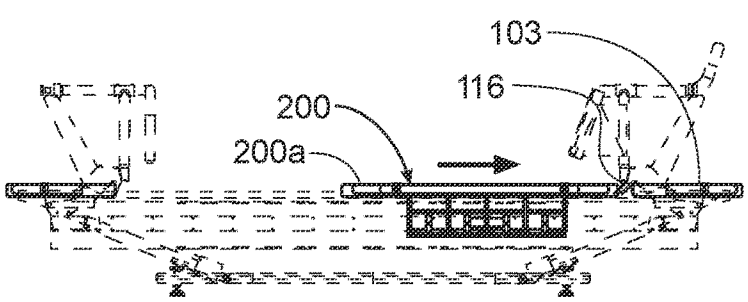
FIG. 3B is a side view of an improved exercise machine as in FIG. 2 with the levitated movable carriage and platform in a position substantially at a second longitudinal end of the machine.
Figure 3A:
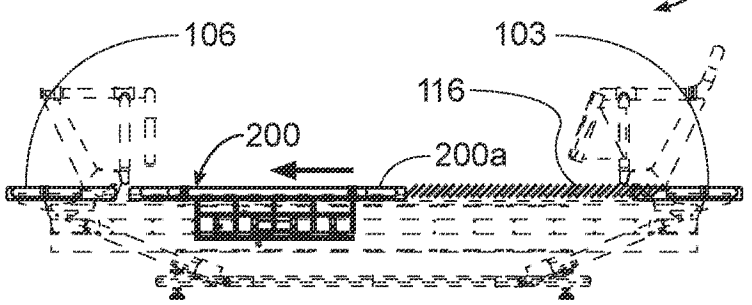
FIG. 3A is a side view of an improved exercise machine as in FIG. 2 with the levitated movable carriage and platform in a position substantially at a first longitudinal end of the machine.

Referring primarily to FIGS. 3A and 3B, an exemplary longitudinal range of motion of the movable levitated carriage 200 relative to the front and back end platforms 103, 106 is illustrated. To better illustrate the range of motion, essentially all of the elements of the example improved exercise machine 500 are illustrated in dashed lines except for the levitated carriage 200, platform 200*a*, and the front end and back end stationary platforms 103, 106. More specifically, and as previously referred to, the movable carriage 200 and platform 200*a* are movable substantially linearly and reciprocally in a direction parallel to the longitudinal axis of the exercise machine 500 over substantially the entire length of the monorail structure 107 between the end platforms 103, 106.

As illustrated in FIG. 3A, the levitated movable carriage 200 and platform 200*a* have been moved to a position proximal to the stationary back end exercise platform 106. A resistance force-inducing biasing means, for instance one or more resistance springs 116 or elastic bands, are removably attached between the levitated carriage 200 or platform 200*a* and the front end stationary platform 103 or other stationary component of the machine 500. Accordingly, for an exerciser 400 to move the levitated movable carriage 200 in the direction toward the back end platform 106, the exerciser 400 must exert a sufficient muscular force to overcome the resistance biasing force of any connected resistance springs 116.

Illustrating an exemplary range of travel of the movable carriage 200 and platform 200*a*, in FIG. 3B the movable carriage 200 and platform 200*a* are shown positioned proximal to the stationary front end exercise platform 103 substantially at or near the opposite longitudinal end of the exercise machine 500. As can be readily seen, in this position of the levitated movable carriage 200 proximal to the front end platform 103, the resistance spring 116 is substantially fully retracted.

Figure 4:
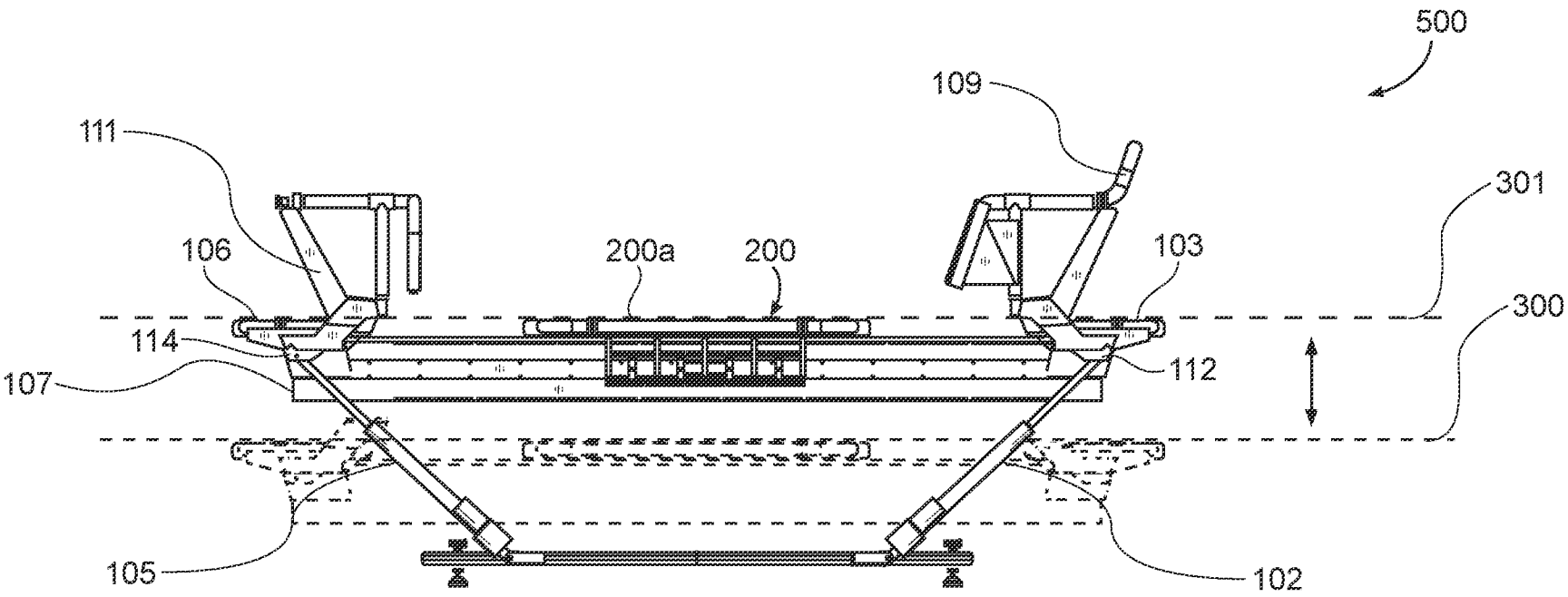
FIG. 4 is a side view of an improved exercise machine with a levitated movable carriage and platform in accordance with an example embodiment with the upper structure of the machine elevated.

Referring primarily to FIG. 4, and as previously indicated, either or both of the back and front ends of the upper frame 118 may be elevated relative to the base 100 of the base 100 using the actuators 101, 102, 104, 105. More specifically, the dashed outline illustrates an exemplary default or starting position of the upper frame 118. In the exemplary default position, the aligned co-planar exercise platforms of the upper frame 118 comprise a substantially horizontal exercise plane 300. By actuating the plurality of actuators, i.e., front right actuator 102, front left actuator 101, back right actuator 105, and back left actuator 104, substantially in unison and to the same extent, the upper frame 118, including the monorail structure 107, front and back end handle assemblies 108-111, front and back end stationary platforms 103, 106, and levitated movable carriage 200 and platform 200*a*, can be elevated to establish a substantially horizontal elevated exercise plane 301 at a greater vertical distance above the floor or other support surface on which the base of the base 100 rests. Alternatively, as referred to previously, and as described further below, the individual actuators 101, 102, 104, 105 may be independently operable so as to cause the front or back end of the upper frame 118 to be elevated relative to the opposite end to create a longitudinally inclined exercise plane 300, and/or to create an exercise plane 300 that is laterally rotated relative to the plane of the lower support base 100 and floor or other support surface.

Figure 5:
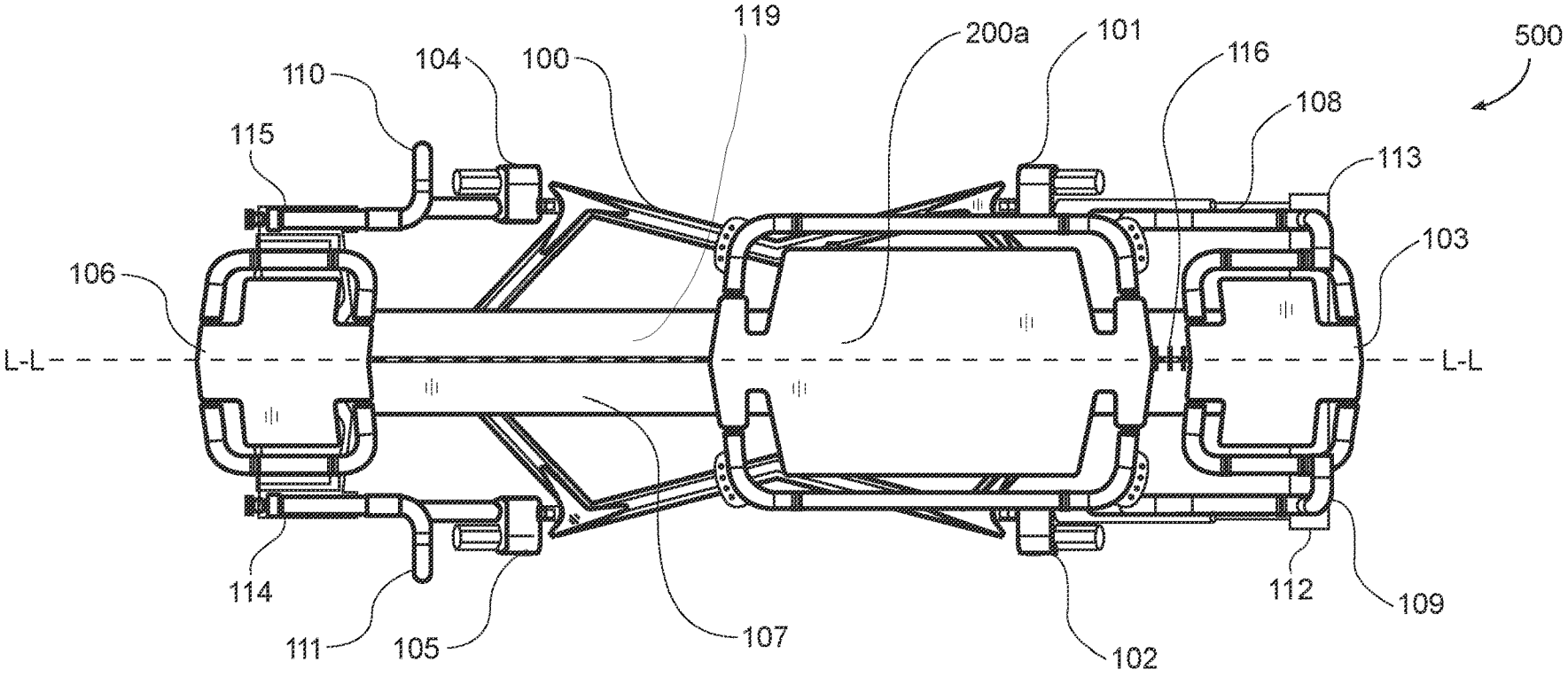
FIG. 5 is a top orthographic view of an improved exercise machine with a levitated movable carriage and platform in accordance with an example embodiment.

Referring to FIG. 5, the example improved exercise machine 500 is a substantially elongated structure with a longitudinal axis L-L and front and back opposite longitudinal ends. The upper frame 118 of the machine comprises a monorail structure 107 that extends longitudinally in alignment with and parallel to the longitudinal axis for substantially the entire length of the machine 500 between the front and back ends. The upper frame 118 also comprises a stationary front end exercise platform 103 mounted substantially at or near the front end of the machine 500 and a stationary back end exercise platform 106 mounted substantially at or near the opposite back end of the machine 500. The upper frame 118 further comprises a magnetically levitated movable carriage 200 with a movable exercise platform 200*a* mounted thereon. The movable carriage 200 and platform 200*a* are movable substantially the entire length of the longitudinal monorail structure 107 between the stationary front and back end platforms 103, 106. The stationary and movable platforms 103, 106, 200*a* may be substantially aligned along the longitudinal axis of the machine 500, thus having upper exercise surfaces that are substantially co-planar.

The upper frame 118 also comprises a front right handle assembly 109, front left handle assembly 108, back right handle assembly 111, and back left handle assembly 110. The front handle assemblies 108, 109 are shown mounted to or near the stationary front end platform structure 103 on opposite lateral sides of the machine 500 to facilitate grasping by an exerciser 400 in connection with using the front end platform 103. Similarly, the back handle assemblies 110, 111 are shown mounted to or near the stationary back end platform structure 106 on opposite lateral sides of the machine 500 to facilitate grasping by an exerciser 400 in connection with using the back end platform 106.

In the exemplary embodiment shown in the figures, the upper frame 118 is supported on the support base 100 of the base 100 of the machine 500 above a floor, ground, or other support surface by a front right linear actuator 102, front left linear actuator 101, a back right linear actuator 105, and back left linear actuator 104. As described above, the four actuators 101, 102, 104, 105 are in communication with either a machine-mounted or remote controller (not shown) that can be actuated to adjust the length of one or more actuators 101, 102, 104, independently so as to alter the exercise plane 300 of the upper frame 118. One or more resistance springs 116 are shown removably attached between the stationary front end platform 103 or other stationary component of the machine 500 and the levitated movable carriage 200 and platform 200*a* to provide a resistance biasing force for resistance training or exercise.

Figure 7:
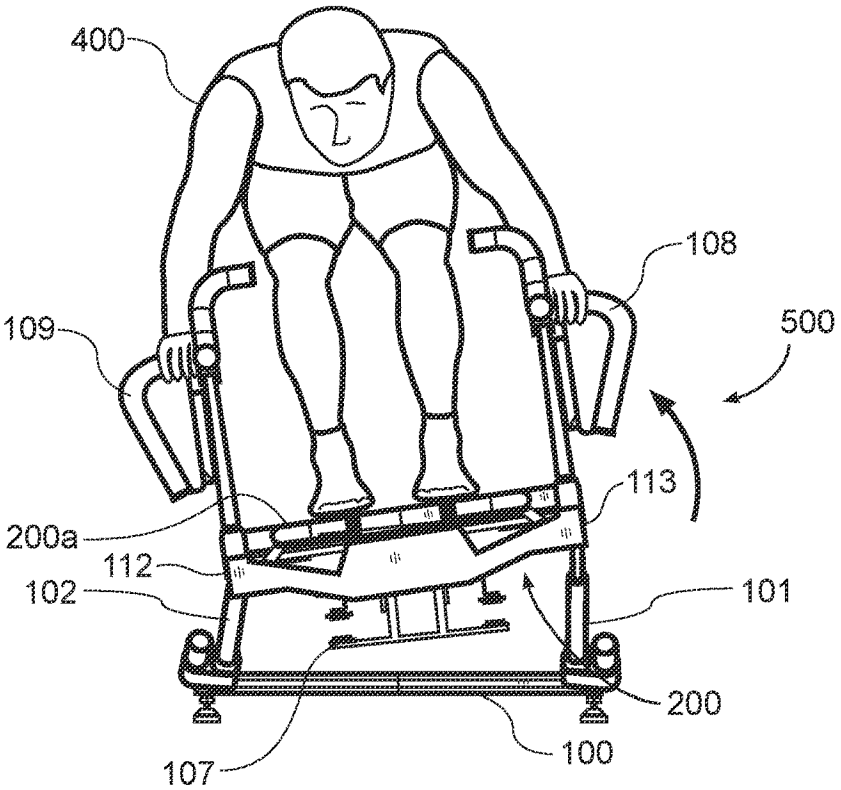
FIG. 7 is a front end orthographic view of an improved exercise machine with a levitated movable carriage and platform in accordance with an example embodiment with an exerciser positioned on the platform and with the upper frame of the machine rotated about its longitudinal axis.
Figure 6:
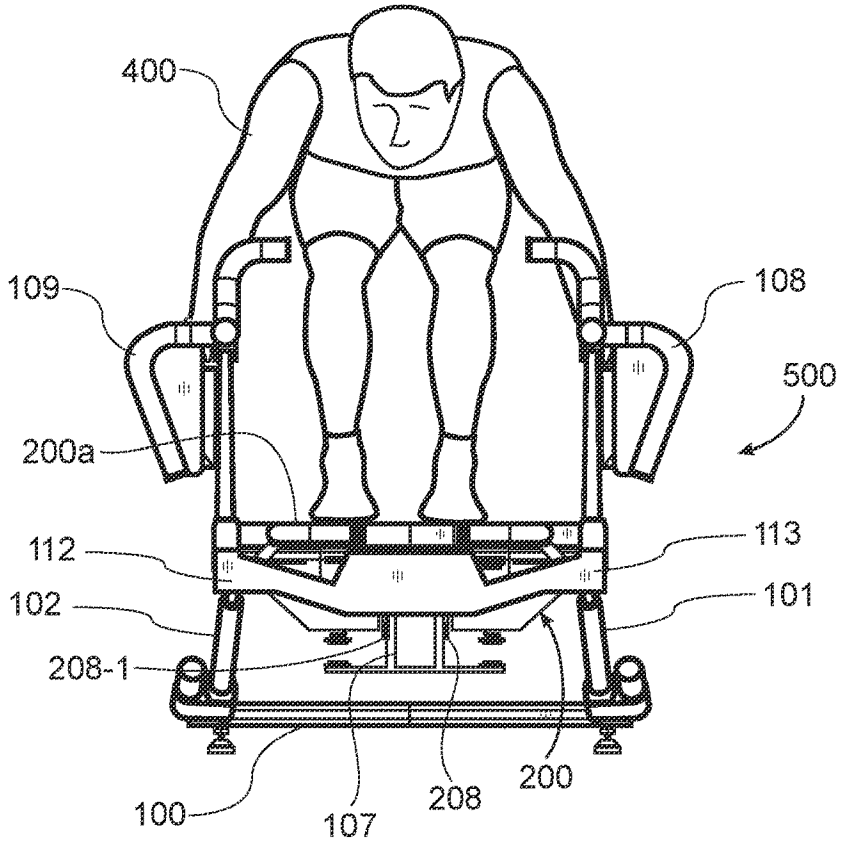
FIG. 6 is a front end orthographic view of an improved exercise machine with a levitated movable carriage and platform in accordance with an example embodiment with an exerciser positioned on the platform.

Referring to FIGS. 6 and 7, an exerciser 400 may position a part of their body on the movable platform 200*a* in order to perform various exercises. For example, as shown in FIG. 6, an exerciser 400 may stand on the platform 200*a* atop the levitated carriage 200 with hands grasping the front left handle assembly 108 and front right handle assembly 109 for balance. The monorail structure 107 as previously described is connected to the front left yoke 113 on the left lateral side of the machine 500 and to the front right yoke 112 on the opposite right lateral side of the machine 500 near the front end of the machine 500.

Although not visible in FIG. 6, the monorail structure is similarly connected to the back left yoke 115 on the left lateral side of the machine 500 and the back right yoke 114 on the opposite right lateral side of the machine 500 near the back end of the machine 500. The extendible distal end of the front left actuator 101 also is movably connected to the front left yoke 113 and the extendible distal end of the front right actuator 102 also is movably connected to the front right yoke 112. Similarly, although not visible in FIG. 6, the extendible distal end of the back left actuator 104 also is movably connected to the back left yoke 115 and the extendible distal end of the back right actuator 105 also is movably connected to the back right yoke 114. As described previously, the proximal ends of the actuators 101, 102, 104, 105 are movably connected to the support base 100 of the base 100 of the machine 500. In the position shown with all actuators 101, 102, 104, 105 in their default retracted positions, the exercise plane 300 of the upper frame 118 of the machine 500, including the movable platform 200*a*, is substantially horizontal and parallel with the substantially horizontal plane of the support base 100.

Alternatively, as seen in FIG. 7, the upper frame 118, including the monorail structure 107, levitated movable carriage 200, and movable platform 200*a* can be rotated about the longitudinal axis of the machine, for example in the counter-clockwise direction shown by the arched arrow. In order to achieve this orientation, in which the plane of the upper frame 118 of the machine is yawed about the longitudinal axis of the machine 500, the front left and back left actuators 101, 104 been extended by substantially the same amount, while the front right and back right actuators 102, 105 have been retracted by substantially the same amount. This in turn causes the exercise plane 300 of the platforms, including the movable platform 200*a*, to yaw about the longitudinal axis of the machine 500. In this position, the exerciser 400 may still stand on the platform 200*a* and grasp the front handle assemblies 108, 109 for support, but the orientation of the exercise plane 300 has been altered from the horizontal. It will be appreciated that it is sometimes preferred to alter the exercise plane 300 from horizontal to facilitate the type of exercise being performed on the machine 500 and/or as a means of stimulating different muscles and muscle groups for enhanced training. The ability to independently operate the actuators 101, 102, 104, 105 is thus preferred to enable altering the orientation of the exercise plane of the upper frame 118.

It will be appreciated that it is often desirable to maintain the opposed magnetic lifting rails 203, 203-1, 205, 205-1 for magnetically levitated movable objects at substantially constant elevations relative to a reference plane, and/or to maintain a substantially constant distance between them, to inhibit the movable object from experiencing a yaw orientation such as illustrated in FIG. 7. However, for the reasons described above, and others that will become clear, it is sometimes desirable and sometimes unavoidable that the levitated movable carriage 200 and platform 200*a* of the improved exercise machine 500 described herein will become yawed relative to the longitudinal axis of the machine. It is desirable that such orientation be achieved in a controlled and limited manner. For that reason, and as more fully described below, pseudo-levitation may be incorporated in an example improved exercise machine 500 in addition to magnetic levitation.

As shown throughout the figures, the upper frame 118 may comprise at least one track 119 which extends for all or part of the length of the exercise machine 500. The figures illustrate an exemplary track 119 comprising a single monorail 107 along which the carriage 200 and platform 200*a* are moved during usage of the exercise machine 500. It should be appreciated, however, that the track 119 could in alternate embodiments comprise a pair of parallel rails which perform the same function as the single monorail 107 shown in the exemplary figures. In other embodiments, additional rails may be utilized.

The monorail 107 may comprise a capital I-shaped configuration such as shown in the figures, with a central vertical member having a horizontal member centered on both its upper and lower ends. The monorail 107 may comprise a first side and a second side, with both the first side and the second side comprising recessed portions defined by the upper and lower vertical members in combination with the central vertical member.

The manner in which the carriage 200 is maintained in position with respect to the monorail 107 may vary in different embodiments. In the exemplary embodiment shown in FIG. 12, the carriage 200 comprises a first undercarriage 201 and a second undercarriage 202. The first undercarriage 201 extends downwardly from the first side 307 of the monorail 107 and the second undercarriage 202 extends downwardly from the second side 308 of the monorail 107. Each undercarriage 201, 202 comprises a vertical portion which extends downwardly and laterally (horizontally or diagonally) portion which extends substantially parallel with respect to the platform 200*a*.

C. Magnetic and Flux Controller Elements

Figure 8:
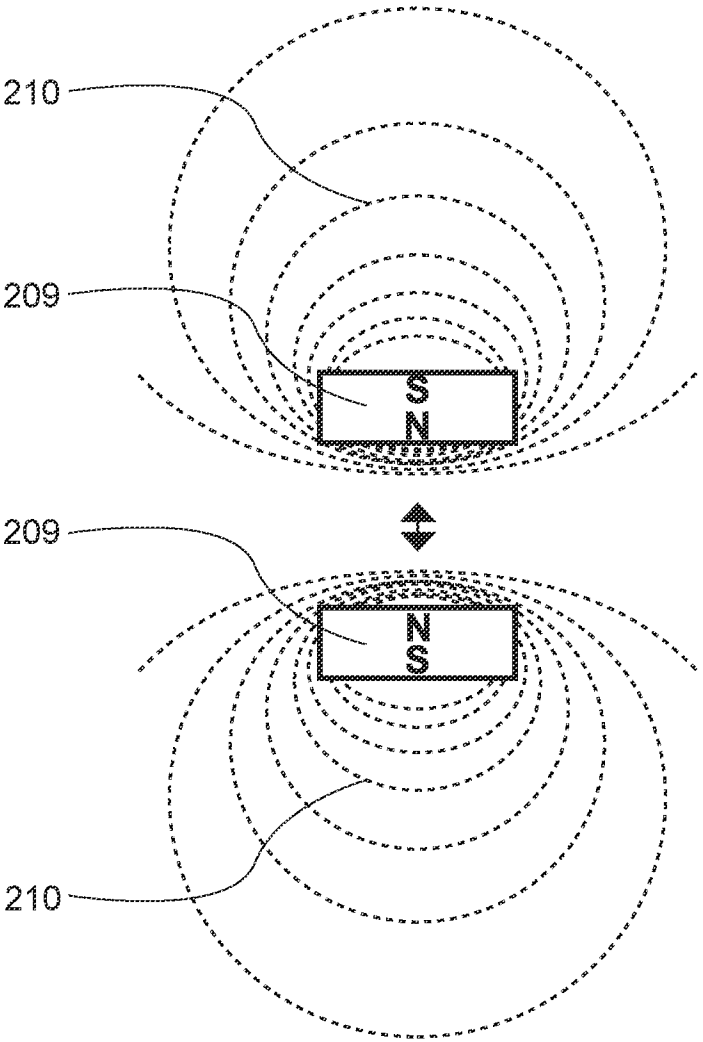
FIG. 8 is a schematic view of two magnets with their corresponding magnetic fluxes positioned to repel each other illustrating one form of levitation force for a movable carriage and platform of an improved exercise machine in accordance with an example embodiment.

Referring primarily to FIG. 8, two magnetic elements 209 are positioned in proximity to one another with their common N poles directly opposed and facing each other. Each magnet 209 generates magnetic flux 210. Because the same or common magnetic poles of the magnetic elements 209 are opposed and facing, the magnetic fields generated result in a repelling magnetic force between the elements in the space between them as illustrated by the two-headed arrow. This force can be applied to levitate an object, such as the movable carriage 200 and platform 200*a* of the example improved exercise machine 500 described herein. However, with the common poles of the magnetic elements 209 being adjacent and facing, the flux 210 generated is scattered in an uncontrolled manner, which dilutes the magnitude of the magnetic repelling force.

The magnetic force required to levitate an object, such as the movable carriage 200 and platform 200*a* of the example exercise machine 500 described herein, is considerable. Add to that the weight of an exerciser 400 on the carriage 200 and even greater magnetic force is required. Using an arrangement of opposed and facing magnetic elements 209 as shown, wherein the flux 210 is scattered and uncontrolled, would require relatively powerful magnetic elements to generate sufficient magnetic force to levitate the carriage 200, platform 200*a* and exerciser 400. However, such powerful magnetic elements are not only undesirably large and heavy, but costly. A more desirable alternative therefore is to better control the flux of the magnetic elements in order to better concentrate and maximize the magnetic repelling force generated between them.

Figure 9:
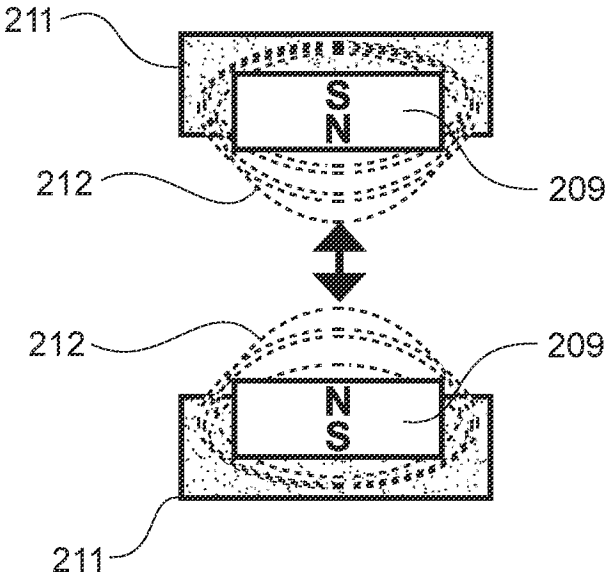
FIG. 9 is a schematic view of two magnets with their corresponding magnetic fluxes concentrated by flux concentrators and positioned to repel each other illustrating one form of levitation force for a movable carriage and platform of an improved exercise machine in accordance with an example embodiment.

Referring to FIG. 9, the two magnetic elements 209 are oriented with their common poles N directly opposed and facing as in FIG. 8. However, in this instance each of the magnetic elements 209 is mounted in a magnetic flux concentrator 211. The magnetic flux concentrators 211 may be constructed of a magnetodielectric material ("MDM") such as but not limited to magnetic steel. Each magnetic flux concentrator 211 has a facing side with at least one opening in the MDM material through which the N pole of the mounted magnetic element 209 is exposed to the exposed N pole of the opposed adjacent magnetic element 209, and a non-facing side comprised of substantially solid MDM material that encases the opposite non-facing S pole of the mounted magnetic element 209.

The magnetic flux concentrator 211 thus shields the non-facing S pole of the mounted magnetic element 209, prevents the flux from scattering, and redirects the flux toward the exposed facing N pole of the opposed adjacent magnetic element 209. In this configuration, the magnetic repelling force generated by the flux-controlled magnets 209 may reach three times the force generated by the same magnets 209 in the same configuration when not retained in flux concentrators 211 constructed of an MDM material.

It will be readily appreciated that while FIGS. 7 and 8 and the corresponding descriptions refer to the common N poles of the adjacent opposed magnetic elements 209 as being adjacent and opposed and as generating the magnetic repelling force for levitation, the magnetic elements 209 could be reoriented so that their common S poles are adjacent and opposed and generate the magnetic repelling force. Either orientation has the same effect and the Figures and descriptions are therefore not intended to be limiting in that regard.

It also will be appreciated that the magnetic flux concentrators 211 may be constructed in a variety of shapes and dimensions consistent with achieving the functions and objectives described. Thus, as will become clearer, the flux concentrators 211 may be constructed as continuous longitudinal rails of MDM material. The flux concentrators 211 thus constructed may be affixed to the opposing adjacent surfaces of the upper and lower magnetic rails 203, 203-1, 205, 205-1 of the monorail structure 107 and the upper and lower carriage rails 204, 204-1, 206, 206-1 of the levitated carriage as previously described (not visible in FIGS. 8-9, but visible in FIG. 12 et al.), and may extend substantially the length of the respective levitation rails to which they are mounted.

Figure 10:
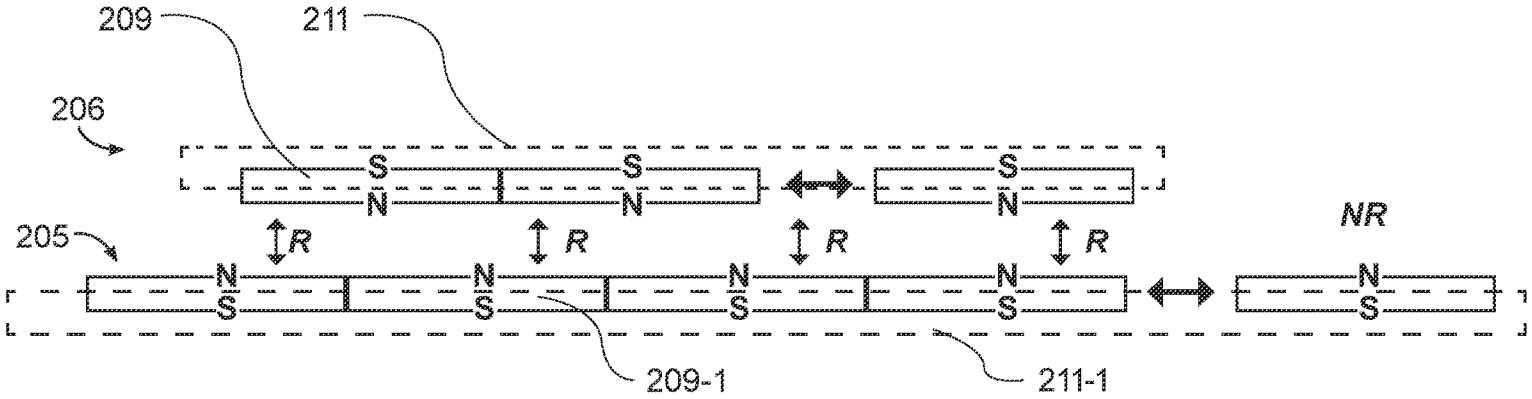
FIG. 10 is a schematic side view of two sets of magnets as applied to a rail of a movable carriage and an adjacent opposed rail of a stationary longitudinal monorail structure respectively of an improved exercise machine in accordance with an example embodiment with the magnets arranged to repel each other illustrating one form of levitation force for the movable carriage.
Figure 11:
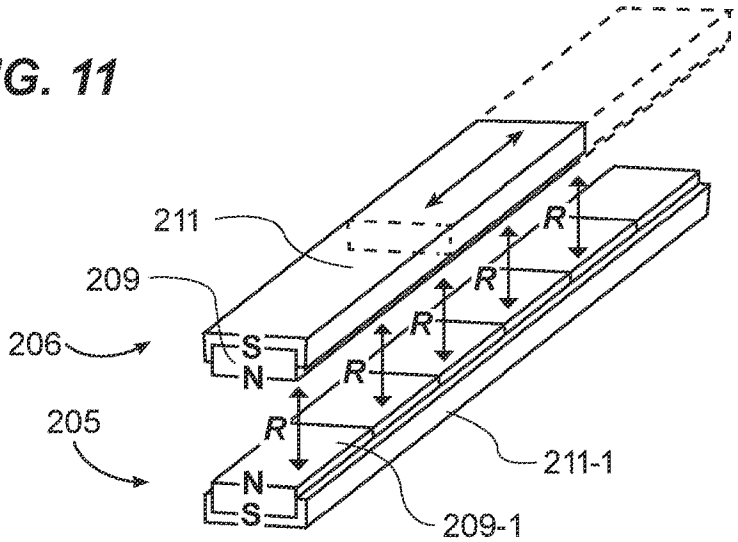
FIG. 11 is an isometric view of two sets of magnets as applied to a rail of a movable carriage and an adjacent opposed rail of a stationary longitudinal monorail structure respectively of an improved exercise machine in accordance with an example embodiment with the magnets arranged to repel each other illustrating one form of levitation force for the movable carriage.

FIGS. 10 and 11 schematically illustrate a configuration or arrangement of longitudinally-extending flux-controlled magnetic elements 209 as applied to opposed adjacent surfaces of one movable-stationary rail pair 205, 206 for levitating the carriage 200 relative to the monorail structure 107. Although the application of the arrangement to one such rail pair 205, 206 is described below, it will be appreciated that the description applies equally with respect to each of the movable-stationary levitation rail pairs.

With that in mind, one of the lower carriage rails 206 of the carriage 200 is positioned proximal to one of the lower magnetic rails 205 of the monorail structure 107. In practice, the lower carriage rail 206, being affixed to the levitated carriage 200 as previously described, is intended to move with the carriage 200 and platform 200*a* relative to the stationary lower magnetic rail 205. Thus, as shown in FIG. 11, as the movable levitated carriage 200 moves from one position to another along the monorail structure 107, the lower carriage rail 206 moves linearly relative to the lower magnetic rail 205 from one position indicated by the dashed outline to another position indicated by the solid line. The lower carriage rail 206 moves linearly along the longitudinal axis of the lower magnetic rail 205 parallel to the longitudinal axes of the monorail structure 107 and the exercise machine 500 as a whole. The double-headed arrow indicates both the linear path of movement of the lower carriage rail 206 and that it is reciprocal.

The lower carriage rail 206 comprises a longitudinally-extending magnetic flux concentrator 211 illustrated in dashed lines in FIG. 10. The magnetic flux concentrator 211 is mounted to a surface of the lower carriage rail 206 that is adjacent and opposed to a surface of the lower magnetic rail 205, and that may extend substantially the length of the levitated carriage 200. A plurality of magnetic elements 209 are mounted to the magnetic flux concentrator 211 and extend substantially the length of the flux concentrator 211. Each of the magnets 209 is oriented such that a common pole, for example the N pole, is exposed in an opening of the magnetic flux concentrator 211 facing the opposed adjacent surface of the lower magnetic rail 205.

Similarly, the lower magnetic rail 205 comprises a longitudinally-extending magnetic flux concentrator 211-1 also illustrated in dashed lines. The magnetic flux concentrator 211-1 is mounted to the surface of the lower magnetic rail 205 that is adjacent and opposed to the surface of the lower carriage rail 206 to which the magnetic flux concentrator 211 is mounted. The magnetic flux concentrator 211-1 may extend substantially the length of the lower magnetic rail 205 of the monorail structure 107 over which the levitated carriage 200 is intended to travel between the front and back ends of the machine 500 as previously described. A plurality of magnetic elements 209-1 are shown mounted to the magnetic flux concentrator 211-1 and extend substantially the length of the flux concentrator 211-1. Each of the magnets 209 is oriented such that a common pole, for example the N pole, is exposed in an opening of the magnetic flux concentrator 211-1 facing the opposed adjacent surface of the lower carriage rail 206.

It will be appreciated that the magnetic elements 209 mounted to the flux concentrator 211 on the lower carriage rail 206 and the magnetic elements 209-1 mounted to the flux concentrator 211-1 on the lower magnetic rail 205 should have the same pole (N or S) exposed and should be positioned directly facing the opposing magnetic elements 209 to generate a strong and consistent magnetic repelling force R between the opposed adjacent rail surfaces 205, 206 over substantially the entire length they are adjacent. The strong repelling force R comprises the lifting or levitation force for the movable carriage 200 relative to the stationary monorail structure 107 wherever the carriage 200 is positioned longitudinally along the monorail structure 107. However, in those areas of the monorail structure 107 where the carriage 200 is not present, none of the magnetic elements 209 on the lower magnetic rail 205 are in proximity to magnetic elements 209 on an opposed and adjacent lower carriage rail 206. In those locations no magnetic repelling force is generated and this instance is illustrated by the letters NR indicating that no repulsive force is exhibited where no magnets 209 of the levitated carriage 200 are present.

It should be understood that while FIGS. 10-11 and the accompanying text show and describe that the N poles of the magnetic elements 209 on each rail 203, 204, 205, 206 are exposed to and face the magnetic elements 209 on the opposed adjacent rail 203, 204, 205, 206, the magnetic elements 209 may be reoriented so that the S poles of the magnetic elements 209 are exposed to and face each other with the same effect. It should also be understood that while the figures and accompanying text describe the application of an arrangement of flux-controlled magnetic elements 209 to a representative pair of adjacent opposed movable-stationary levitation rails 203, 204, 205, 206 on one lateral side of the monorail structure 107, substantially the same arrangement should be applied to the substantially identical pair of movable-stationary levitation rails 203, 204, 205, 206 on the opposite lateral side of the monorail structure 107 so as to provide a balanced lifting or levitation force acting upon the levitated carriage 200. It is also contemplated that a plurality of movable-stationary levitation rail pairs may be provided either on opposite lateral sides of the monorail structure 107 or as additional elements separate from or in place of the monorail structure 107 to provide additional lifting or levitation force to the levitated carriage as needed or desired.

It also should be understood that although a particular arrangement of magnetic elements 209 and magnetic flux concentrators 211 is illustrated in FIGS. 10 and 11 and described in the accompanying text, many other arrangements are possible to achieve the functions and objectives described. Thus, the example embodiments described herein are not intended to be limited by or to the particular arrangement of magnetic elements 209 and flux concentrators 211 shown and described. For example, while the magnetic elements 209 are illustrated as being arranged longitudinally end to end, the magnetic elements 209 could be arranged with gaps between them. Further, while the magnetic elements 209 are illustrated as being rectangular in shape, they may be square, round or any other shape.

D. Magnetic and Pseudo-Levitation and Stability Elements

As discussed in more detail below, the monorail 107 may comprise a pair of upper magnetic rails 203, 203-1 and a pair of lower magnetic rails 205, 205-1. The upper magnetic rails 203, 203-1 face downwardly and are positioned at or near the upper end of the monorail 107, with the first upper magnetic rail 203 being positioned on the first side 307 of the monorail 107 and the second upper magnetic rail 203-1 being positioned on the second side 308 of the monorail 107.

The lower magnetic rails 205, 205-1 face upwardly and are positioned at or near the lower end of the monorail 107, with the first lower magnetic rail 205 being positioned on the first side 307 of the monorail 107 and the second lower magnetic rail 205-1 being positioned on the second side 308 of the monorail 107. It should be appreciated that the upper magnetic rails 203, 203-1 and the lower magnetic rails 205, 205-1 may extend along all or part of the length of the exercise machine 500. For example, if the overall length of the exercise machine 500 is greater than the length of the portion of the track 119 along which the carriage 200 is to be moved, the upper magnetic rails 203, 203-1 and lower magnetic rails 205, 205-1 may only extend to part of the length of the exercise machine 500.

In embodiments in which the track 119 or monorail 107 comprises multiple parallel rails, the first upper and lower magnetic rails 203, 205 may be connected to a first of such rails and the second upper and lower magnetic rails 203-1, 205-1 may be connected to a second of such rails. In other embodiments, the magnetic rails 203, 203-1, 205, 205-1 may each be connected to their own rail.

Figure 12:
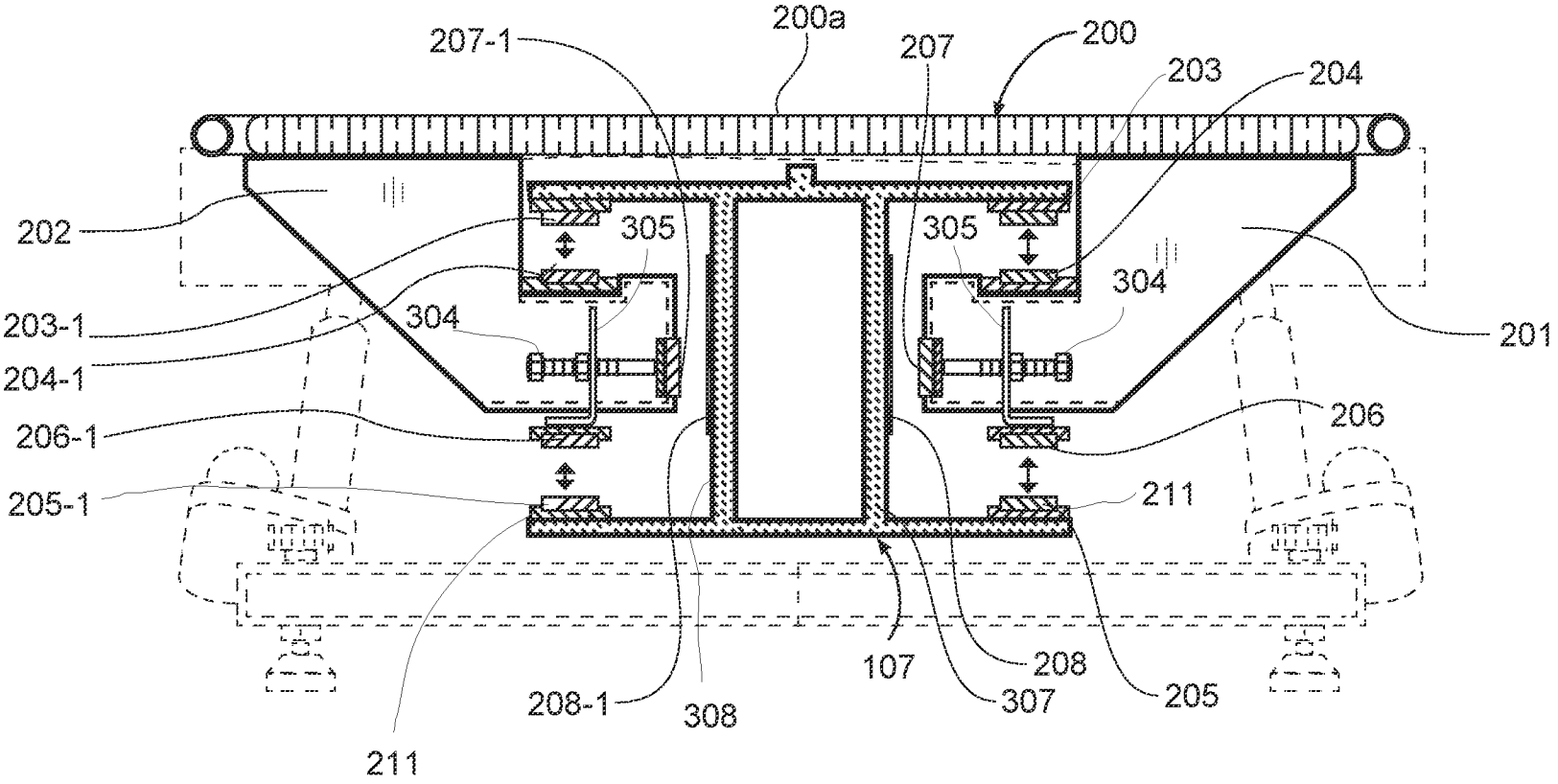
FIG. 12 is a transverse cross-sectional view of a magnetically levitated movable carriage and platform of an improved exercise machine in accordance with an example embodiment taken along section line A-A of FIG. 2.

Each of the magnetic rails 203, 203-1, 205, 205-1 may comprise a magnetic material in an elongated form which runs along the track 119. In some embodiments, the magnetic rails 203, 203-1, 205, 205-1 may each comprise a plurality of magnet elements 209 which form a strip extending along the track 119. The number of magnetic elements 209 used to form any of the magnetic rails 203, 203-1, 205, 205-1 may vary in different embodiments. In some embodiments, the magnetic rails 203, 203-1, 205, 205-1 may each comprise one or more electromagnets. Although FIG. 12 illustrates an exemplary embodiment in which magnetic rails 203, 203-1, 205, 205-1 have upwardly and downwardly extending magnetic fields, it should be appreciated that in other embodiments the magnetic rails 203, 203-1, 205, 205-1 may instead extend horizontally or diagonally.

The movable carriage 200 may include a pair of upper carriage rails 204, 204-1 and a pair of lower carriage rails 206, 206-1. The upper carriage rails 204, 204-1 face upwardly and are positioned on the upper end of the laterally-extending portions of the undercarriages 201, 202 of the carriage 200, with the first upper carriage rail 204 being positioned on the first undercarriage 201 and the second upper carriage rail 204-1 being positioned on the second undercarriage 202.

The lower carriage rails 206, 206-1 face downwardly and are positioned on the lower end of the laterally-extending portions of the undercarriages 201, 202 of the carriage 200, with the first lower carriage rail 206 being positioned on the first undercarriage 201 and the second lower carriage rail 206-1 being positioned on the second undercarriage 202. It should be appreciated that the upper carriage rails 204, 204-1 and the lower carriage rails 206, 206-1 may extend along all or part of the length of carriage 200.

Each of the carriage rails 204, 204-1, 206, 206-1 may comprise a magnetic material in an elongated form which runs along the undercarriages 201, 202 of the carriage 200. In some embodiments, the carriage rails 204, 204-1, 206, 206-1 may each comprise one or more magnetic elements 209 on the carriage 200. The number of carriage magnets forming each carriage rail 204, 204-1, 206, 206-1 may vary in different embodiments. In some embodiments, the carriage rails 204, 204-1, 206, 206-1 may comprise one or more electromagnets. In some embodiments, the carriage rails 204, 204-1, 206, 206-1 may not be elongated, but instead each comprise at least one square, circular, triangular, or other shaped magnetic element 209.

As previously referred to, magnetic levitation force applied to the movable carriage 200 and platform 200*a* allow the carriage 200 and platform 200*a* to move linearly and reciprocally along the monorail structure 107 between the front and back ends of the exercise machine 500 with substantially no physical contact between the movable carriage 200 and the monorail structure 107 and hence substantially no friction or added resistance force. In addition to the magnetic levitation forces applied to the carriage 200, it may be desirable to provide additional magnetic forces to help stabilize the carriage 200 during movement. It may also be desirable to provide pseudo-levitation in some instances in which external forces applied to the carriage 200 directly or through the platform 200*a* cause the carriage 200 and platform 200*a* to yaw relative to the longitudinal axis of the exercise machine 500.

FIG. 12 illustrates a sectional view of the magnetically levitated movable carriage 200 and exercise platform 200*a* shown in side view in FIG. 2 taken along the section line A-A. The base 100, actuators 101, 102, 104, 105 and lifting yokes 112, 113, 114, 115 of the machine 500 have been previously described and are shown as dashed lines so as not to obscure the view of the various magnetic-levitation and pseudo-levitation elements described below.

As shown and as previously referred to, the levitated carriage 200 comprises a top exercise platform 200*a*, a right undercarriage assembly 201 and a left undercarriage assembly 202. The levitated carriage 200 straddles the monorail structure 107 with laterally-extending portions of the right and left undercarriage assemblies 201, 202 extending between the right upper and lower magnetic rails 203, 205 and the left upper and lower magnetic rails 203-1, 205-1 of the monorail structure 107 on opposite right and left lateral sides of the monorail structure 107.

The upper and lower carriage rails 204, 206 of the right undercarriage assembly 201 are positioned substantially vertically aligned with, adjacent to, and facing the right upper and lower magnetic rails 203, 205 respectively, establishing a right movable-stationary lifting or levitation rail pair 205, 206 and a right movable-stationary pre-load rail pair 203, 204 as described further below. Similarly, the upper and lower carriage rails 204-1, 206-1 of the left undercarriage assembly 202 are positioned substantially vertically aligned with, adjacent to, and facing the left upper and lower magnetic rails 203-1, 205-1 respectively, establishing a left movable-stationary lifting or levitation rail pair 205-1, 206-1, and a left movable-stationary pre-load rail pair 203-1, 204-1 also described further below.

It will be appreciated that opposed magnetic elements 209 arranged with the same N or S poles facing may exhibit instability along at least one plane. As illustrated in FIG. 12, vertical magnetic lifting or levitation force is applied to opposite lateral sides of the carriage 200 in the form of the magnetic repelling forces between the right lower magnetic and carriage rails 205, 206 and the left lower magnetic and carriage rails 205-1, 206-1. However, the stability of the vertical magnetic lifting force is assured only if the opposing magnetic elements 209 are retained in vertical alignment. Therefore, it is desirable also to apply equal lateral forces to the levitated carriage 200 so as to maintain vertical alignment of the lifting rails.

In addition and as will be shown, the unique stability requirements of the levitated carriage 200 of the improved exercise machine 500 described herein required a novel levitation structure that provides for not only lifting forces, but also downward pressure to preload the lifting forces. In the description that follows, it should be noted that the description of the lifting and other elements on one lateral side of the monorail structure 107, e.g., the left side, apply equally to mirror image elements on the opposite lateral side of the monorail structure 107, e.g., the right side.

As noted, the left undercarriage assembly 202 affixed to the movable levitated carriage 200 has upward facing magnetic elements arranged on an upper carriage rail 204-1 and downward facing magnetic elements arranged on a lower carriage rail 206-1. Similarly, the right undercarriage assembly 201 has upward facing magnetic elements arranged on an upper carriage rail 204 and downward facing magnetic elements arranged on a lower carriage rail 206. Each of the carriage rails 204, 206 may be substantially equal in length to the length of the movable carriage 200, and may be fixedly connected to the undercarriage assembly 201, 202 so as to move concurrently with the carriage 200 along an axis parallel to the longitudinal axis of the monorail structure 107. As previously noted, the magnetic elements 209 on each of the upper and lower carriage rails 203, 204, 205, 206 comprise an elongated arrangement of flux concentrators 211 and magnetic elements 209 substantially as in FIGS. 10-11 that may extend substantially the length of the rails 203, 204, 205, 206.

The monorail structure 107 comprises a left upper magnetic rail 203-1 and a left lower magnetic rail 205-1 both affixed to the left lateral side of the body of the monorail structure 1007, and a right upper magnetic rail 203 and right lower magnetic rails 205 both affixed to right lateral side of the monorail body 107. The lower magnetic rails 205, 205-1 have magnetic elements 209 facing upward while the upper magnetic rails 203, 203-1 have downward facing magnetic elements 209.

The left upper and lower magnetic rails may be positioned adjacent to, substantially vertically aligned with, and facing respective left upper and lower carriage rails 204-1, 206-1. Similarly, the right upper and lower magnetic rails 203, 205 may be positioned adjacent to, substantially vertically aligned with, and facing respective right upper and lower carriage rails 204, 206. As previously noted, the magnetic elements 209 on each of the upper and lower magnetic rails 203, 204 of the monorail 107 comprise an elongated arrangement of flux concentrators 211 and magnetic elements 209 substantially as in FIGS. 10-11 that extend substantially the length of the rails 203, 204 over which the carriage 200 is intended to travel.

The lifting or levitation forces on the carriage 200 are provided by the magnetic repelling forces created by the upward facing magnetic elements 209 of the right and left lower magnetic rails 205, 205-1 and the downward facing magnetic elements 209 of the same polarity on the adjacent and opposed surfaces of the corresponding right and left lower carriage rails 206, 206-1. Thus, the right and left movable-stationary rail pairs 205, 206 and 205-1, 206-1 may be referred to as the lifting or levitation rails.

The downward forces that may be applied to the levitated carriage 200 during expected use are highly variable, ranging for instance, from ten to 20 Kg, to more than 150 Kg once an exerciser 400 has mounted the platform 200*a* atop the carriage 200. Therefore, the lifting forces applied to the carriage 200 must be sufficient to maintain levitation relative to the monorail structure 107 over the entire expected range of downward force that may be applied. However, applying lifting forces sufficient to counteract a substantial amount of downforce that may be applied to the carriage 200, e.g., from an exerciser 400 mounting the platform 200*a*, when no such downforce is actually present could cause the carriage 200 and platform 200*a* to be elevated vertically relative to the monorail 107 and base 100 by an undesirable amount when no exerciser is present. By pre-loading the levitation rails with a downward pre-loading force, the vertical distance between the base 100 and the top surface of the exercise platform 200*a* can be maintained within a more desirable range, for example to better facilitate exercisers 400 mounting the platform 200*a*.

The desired downward pre-load forces on the carriage 200 are provided by the magnetic repelling forces created by the downward facing magnetic elements 209 on the right and left upper magnetic rails 203, 203-1 and the upward facing magnetic elements of the same polarity on the adjacent and opposed surfaces of the corresponding right and left lower carriage rails 204, 204-1. Thus, the right and left movable-stationary rail pairs 203, 204 and 203-1, 204-1 may be referred to as the pre-load rails.

The opposed magnetic elements 209 of the lifting and preload rails 203, 204, 205, 206 provide opposed upward lifting forces and downward pre-load forces that are sufficient to stabilize and maintain the exercise platform 200*a* atop the levitated carriage 200 in a substantially horizontal exercise plane over the entire anticipated range of carriage-plus-exerciser weight.

In addition to the above, instability of the system can occur along an axis transverse to the longitudinal axes of the monorail structure 107, lifting rails 205, 206, and pre-load rails 203, 204. Therefore, it may be desirable to provide an eddy brake system between the monorail structure 107 and movable levitated carriage 200 to help maintain vertical alignment of the upper and lower lifting rails 205, 206 and the upper and lower pre-load rails 203, 204 on the opposite lateral sides of the monorail structure 107.

The eddy brake system of the example machine may comprise a pair of right and left high force dipole eddy current brake magnets 207, 207-1 and a corresponding pair of right and left non-ferrous braking rails 208, 208-1. The brake magnets 207, 207-1 may be affixed on the carriage 200 so as to move with the carriage 200 relative to the stationary monorail structure 107. Thus, the right and left brake magnets 207, 207-1 are adjustably affixed to substantially vertical surfaces of the laterally-extending portions of the right and left undercarriage assemblies 201, 202 that are adjacent to and facing respective substantially vertical right and left lateral side surfaces of the monorail body 107 such as shown in FIG. 12. Both of the right and left brake magnets 207, 207-1 are oriented with their respective north and south poles aligned along an axis substantially transverse to the longitudinal axis of the monorail structure 107.

The eddy current brake magnets 207, 207-1 may be seated within structures constructed of an MDM material as previously described in connection with FIGS. 8-11 so as to a) provide a flux concentration aimed toward the corresponding braking rails 208, 208-1 on the adjacent facing surfaces of the monorail structure 1007, and b) to shield unwanted flux from influencing the flux patterns generated by the magnetic elements 209 of the lifting rails 205, 206 and pre-load rails 203, 204. As desired or necessary, one or more eddy current brake magnets 207 may be seated in the preferred MDM structures and may extend longitudinally along the length of the carriage 200 similarly to the arrangement shown in FIGS. 10-11.

The right and left braking rails 208, 208-1 are mounted to substantially vertical left and right lateral side surfaces of the monorail body 107 that are adjacent to and facing the substantially vertical surfaces of the undercarriage assemblies 201, 202 on which the corresponding brake magnets 207 are mounted. The braking rails 208, 208-1 may extend longitudinally along the lateral vertical side surfaces of the monorail body 107 for substantially the entire distance that the carriage 200 is intended to travel along the monorail 107. The braking rails 208, 208-1 may be constructed of a non-ferrous material. Although non-ferrous materials used in eddy brakes are often copper, zinc, or aluminum, aluminum is a preferred material for the braking rails 208, 208-1 in this application because aluminum provides more efficient speed reduction of an object with eddy current brake magnets 207 as compared to other materials.

The corresponding brake magnets 207 and braking rails 208 may be mounted directly opposite to each other on the respective opposed facing surfaces of the carriage 200 and monorail structure 107. Thus, as the carriage 200 moves linearly along and parallel with the longitudinal axis of the monorail structure 107, the brake magnets 207 move linearly along and in proximity to the corresponding adjacent facing braking rails 208.

As the brake magnets 207 move along and in proximity to the corresponding braking rails 208, they project concentrated magnetic flux toward the braking rails 208. The braking rails 208 induce a resistance force against and opposing the direction of movement of the brake magnets 207. The amount and direction of the resistance force induced depends on the distance between the brake magnets 207 and corresponding braking rails 208 and the relative direction of movement of the brake magnets 207 relative to the braking rails 208. Thus, when the eddy current brake magnets 207 on the opposite lateral sides of the monorail structure 107 are properly and equally adjusted, they induce the necessary opposing lateral forces needed to maintain vertical alignment of the longitudinal lifting and pre-load rails 203, 204, 205, 206. Further, the eddy current brakes 207 provide for damping of vibration of the levitated carriage 200 during movement along the longitudinal axis which is desirable during operation and use of the exercise machine.

A variety of mechanisms may be provided to adjust the positions of the eddy brake magnets 207 in a direction substantially transverse to the longitudinal axis of the monorail structure 107 so as to adjust the distance between the eddy brake magnets 207, 207-1 and the corresponding adjacent facing braking rails 208, 208-1. For example, the eddy brake magnets 207 may be mounted to the distal ends of threaded bolts facing the corresponding braking rails 208. The threaded portions of the bolts may extend through openings in vertical brackets mounted on the lateral extensions of the undercarriage assemblies 201, 202 of the levitated carriage 200 and adjustment nuts may be installed on the threaded portions of the bolts. With this arrangement, the bolts may be rotated to bring the eddy brake magnets 207 into the desired position relative to the facing brake rails 208. The nuts may then be tightened against a surface of the bracket to maintain the eddy brake magnets 207 in the desired position.

Figure 13:
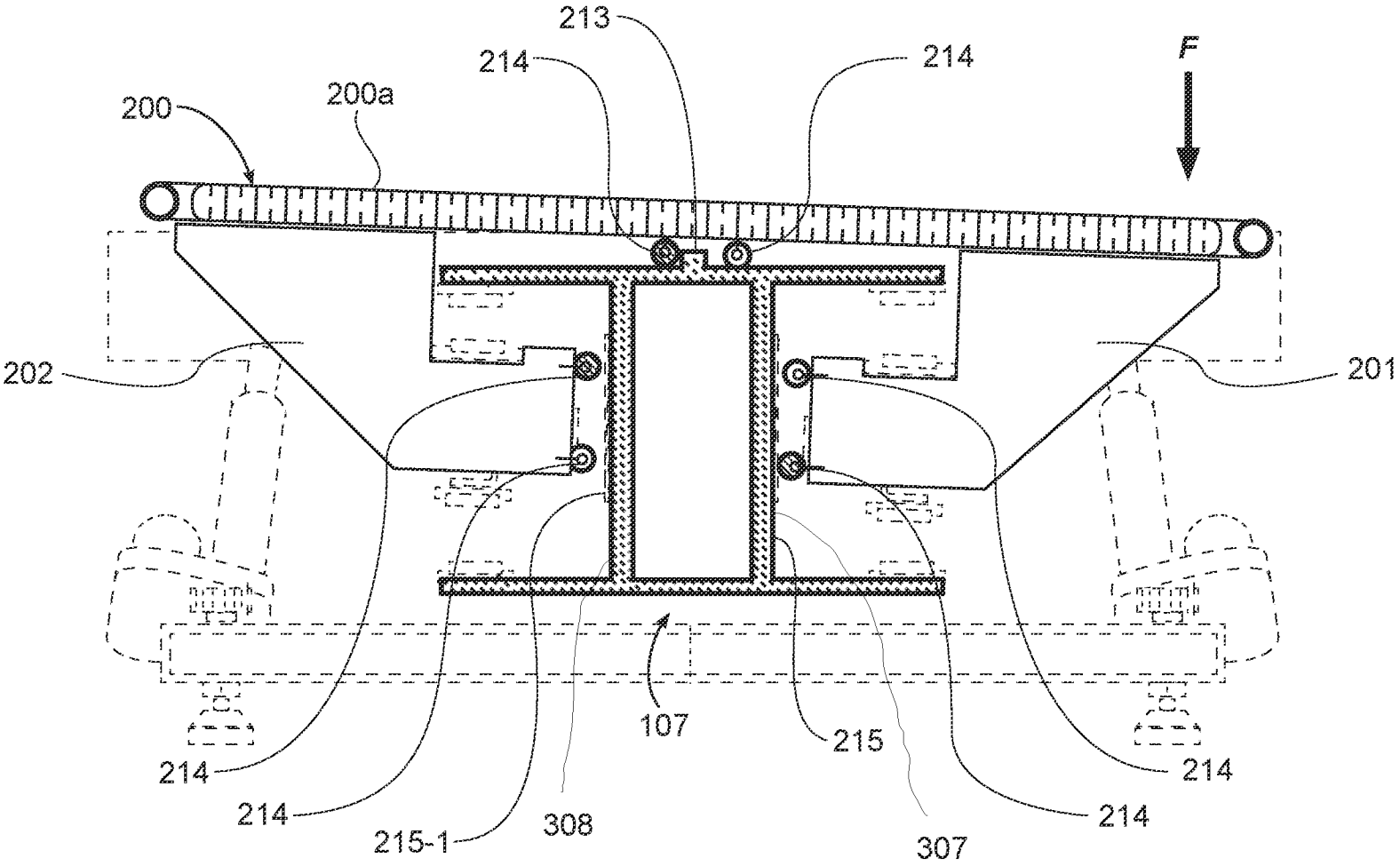
FIG. 13 is the transverse cross-sectional view of the magnetically levitated movable carriage and platform of an improved exercise machine as shown in FIG. 12 with the carriage and platform tilted to illustrate the application of pseudo-levitation to the carriage and platform.

Referring to FIG. 13, and as indicated previously, it may be desirable to provide pseudo-levitation elements on the carriage 200 and/or the monorail structure 107 in addition to the magnetic levitation, pre-load, and stabilization elements. FIG. 13 illustrates previously described components of the exercise machine that are not necessary to an understanding of the pseudo-levitation components, such as the base support structure 100, actuators 101, 102, 104, 105, etc., as dashed outlines so as not to obscure visibility of the pseudo-levitation components described below.

As previously indicated, significant variations in the downward forces applied to the exercise platform 200*a* and/or the carriage 200 can be expected during use of the exercise machine 500 due to the weight of the carriage 200 itself, the added weight of an exerciser 400, and other external forces. Moreover, these downward forces are unlikely to be equally distributed along the top surface of the platform 200*a*. For instance, as indicated by the location of the downward pointing arrow, an exerciser 400 who is mounting the machine 500 may step on one lateral edge of the platform 200*a*, causing a torsional force F that induces the carriage 200 to rotate about the longitudinal axis of the monorail structure 107. Unbalanced forces on the platform 200 and carriage 200*a* may temporarily exceed the opposed magnetic levitation and pre-load forces acting to levitate and stabilize the carriage in a substantially horizontal exercise plane 300, and may cause unwanted mechanical interference between the carriage 200 and monorail structure 107. As one method of further maintaining carriage stability during temporary torsional loading, a pseudo-levitation system provides for a network of mechanical rollers or bearings 214 at and acting as points of temporary physical contact between the levitated carriage 200 and the monorail structure 107.

More specifically, a plurality of anti-torsion roller or wheel bearings 214 may be affixed rotatably to the levitated carriage 200 at various locations. Additionally, one or more such bearings 214 may be affixed to the static monorail structure 107 at various locations. The anti-torsion bearings 214 provide temporary, low rolling resistance between the carriage 200 and monorail 107 at points of contact that may occur between them due to excessive torsional forces as described above. In one example embodiment, one or more anti-torsion bearings 214 are affixed to substantially vertical surfaces of the laterally-extending portions of the right and left undercarriage assemblies 201, 202 that are adjacent to and in proximity with respective substantially vertical right and left opposite lateral sides of the monorail body 107 when the levitated carriage 200 is stabilized. The anti-torsion bearings 214 may be positioned on the vertical surfaces with one or more bearings 214 or sets of bearings 214 being vertically aligned with each other.

Corresponding right and left bearing rails 215, 215-1 are affixed to the substantially vertical opposite lateral sides of the monorail body 107 opposite the respective anti-torsion bearings 214, 214-1 and may extend substantially the length of the monorail structure 107 to ensure that the anti-torsion bearings 214 mounted on the carriage 200 will contact the bearing rails 215, 215-1 when the carriage 200 is positioned anywhere along it's intended length of travel. The bearing rails 215, 215-1 may be constructed of the same non-ferrous material as the eddy current braking rails 208, 208-1 previously described, or may be constructed of a less or more ductile metal or composite material.

As a further method of maintaining the centerline of the carriage 200 substantially in alignment with the longitudinal centerline of the monorail structure 107, an anti-torsion rail 213 may extend upwardly from the top surface of the monorail structure 107. The anti-torsion rail 213 may extend longitudinally for substantially the entire length of the monorail 107 along which the carriage 200 is intended to travel. One or more additional anti-torsion bearings 214 may be mounted on the top surface of the monorail structure 107 or the bottom surface of the platform 200*a* adjacent to and on opposite lateral sides of the anti-torsion rail 213 such as shown in FIG. 13.

The effect of the pseudo-levitation system is illustrated in FIG. 13 in response to a destabilizing force F being applied at or near the right lateral edge of the platform 200*a* that is sufficient to temporarily overcome the magnetic levitation and pre-load forces on the carriage 200 and that causes the carriage 200 to rotate about the longitudinal axis of the monorail structure 107 in a clockwise direction. As illustrated, three of the anti-torsion bearings 214 are illustrated as hatched circles and represent bearings 214 that have become temporary contact points with surfaces of the monorail structure 107 in response to the destabilizing force F.

In the instance shown in FIG. 13, the bearing 214 to the left of the anti-torsion rail 213 has come into contact with the anti-torsion rail 213. This bearing 214 acts to maintain the center alignment of the carriage 200 with the longitudinal center of the monorail structure 107. Additional points of contact between the carriage 200 and rail 215 have occurred where the upper bearing 214 of the left undercarriage assembly 202 has come into contact with the left bearing rail 215-1, and further where the lower bearing 214 of the right undercarriage assembly 201 has come into contact with the right bearing rail 215. As can be readily seen, the destabilizing force F acting upon the carriage 200 disrupts the desired condition wherein the lifting rails 205, 206 and pre-load rails 203, 204 of the carriage 200 and the monorail structure 107 are vertically aligned and equidistant from each other on the opposite lateral sides of the monorail structure 107. The anti-torsion bearings 214 as just described provide instant pseudo-levitation of the carriage 200 in such instances to help temporarily stabilize the carriage 200.

As previously described in connection with FIG. 7, it is sometimes desirable to intentionally rotate the monorail structure 107 as well as the levitated carriage 200 about the longitudinal axis of the machine 500 so as to facilitate the performance of particular exercises and/or to target various muscle groups. This can be accomplished for example by activating the various actuators 101, 102, 104, 105 connected to the upper frame 118 of the exercise machine 500, as previously described.

Figure 14:
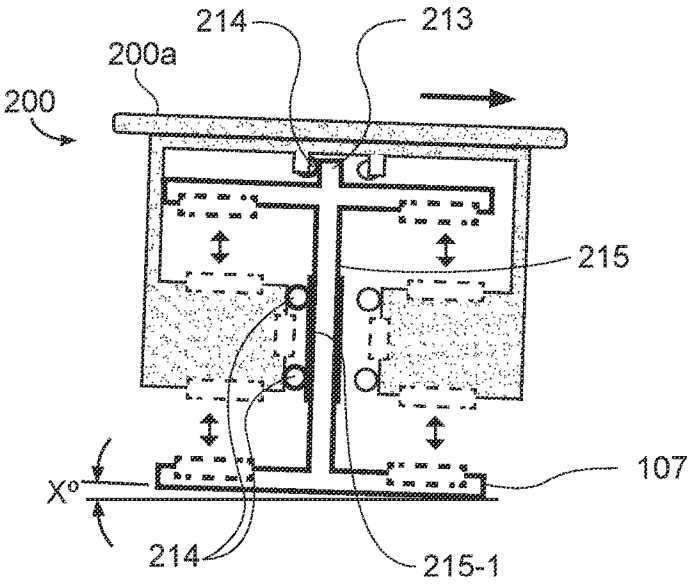
FIG. 14 is a schematic end view of a variation of a magnetically levitated movable carriage and platform of an improved exercise machine in accordance with an example embodiment with the carriage rotated about a longitudinal axis and the platform tilted in the same direction by a lateral force illustrating the application of pseudo-levitation to the carriage and platform.
Figure 15:
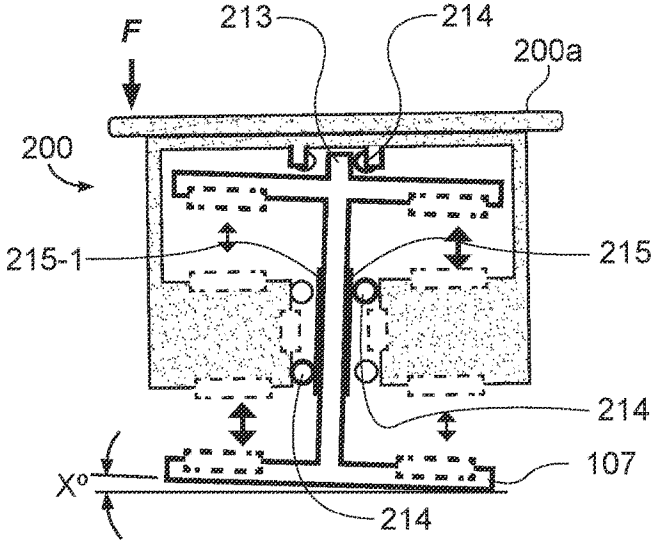
FIG. 15 is a schematic end view of a variation of a magnetically levitated movable carriage and platform of an improved exercise machine in accordance with an example embodiment with the carriage rotated about a longitudinal axis and the platform tilted in the opposite direction by a vertical force illustrating the application of pseudo-levitation to the carriage and platform.

FIGS. 14 and 15 schematically illustrate a variation of an example exercise machine having a magnetically levitated and stabilized movable carriage 200 and exercise platform 200*a*, a stationary monorail structure 107, and a pseudo-levitation system. More specifically, referring to FIG. 14, the monorail structure 107 comprises a single substantially vertical center portion joining upper and lower laterally extending magnetic rails 203, 205 substantially at the mid-points. Otherwise, the magnetic lifting and pre-load elements, the magnetic stabilization elements, and the pseudo-levitation elements are arranged in substantially the same manner as previously described.

The monorail structure 107 is shown rotated clockwise at an undefined angle X relative to the substantially horizontal plane of the base support structure (not shown) and the floor or other support surface on which it rests. It will be appreciated that the rotation of the magnetic levitation structures and the corresponding lifting rails causes the imaginary vertical line through the center of the lifting and pre-load magnets 209 to skew from the gravitational centerline, i.e., causes the lifting and pre-load rails and associated magnetic elements to become vertically misaligned, resulting in the levitated carriage 200 and platform 200*a* becoming laterally unstable.

When the monorail structure 107 is rotated as described, the levitated carriage 200 and platform 200*a* are induced to slide laterally in the direction of the rotation relative to the longitudinal centerline of the monorail structure 107. Although preferably a temporary condition, the carriage 200 may encounter mechanical interference at one or more points of contact with the monorail structure 107. To mitigate potentially damaging effects of the mechanical interference, a plurality of anti-torsion bearings 214 as previously described are affixed as shown to various surfaces of the levitated carriage 200.

More specifically, one or more anti-torsion bearings 214 are mounted to the substantially vertical surfaces of the laterally-extending portions of the right and left undercarriages 201, 202 that are adjacent to and facing the respective substantially vertical surfaces on the right and left lateral sides of the center portion of the monorail structure 107. In addition, one or more anti-torsion bearings 214 are mounted to the underside of the top surface of the carriage 200 on which the platform 200*a* is mounted in proximity and on either side of the longitudinal centerline of the carriage 200.

Further, an anti-torsion rail 213 as previously described preferably extends upwardly on the longitudinal centerline of the monorail structure 107 from the top surface of the monorail structure 107. The anti-torsion rail 213 extends longitudinally for the entire length that the carriage 200 is intended to move along the monorail 107. Still further, bearing rails 215, 215-1 as previously described are mounted to the substantially vertical surfaces on the right and left lateral sides of the center portion of the monorail structure 107 directly opposite and facing the anti-torsion bearings 214 on the adjacent vertical surfaces of the carriage 200. The bearing rails 215 extend longitudinally along the opposite lateral sides of the monorail 107 for substantially the entire distance the carriage 200 is intended to travel along the monorail 107.

In the rotated condition of the monorail 107 and carriage 200 described above, as the carriage 200 moves longitudinally along the monorail 107, the top left bearing 214 rolls along the left edge of the anti-torsion rail 213 of the monorail structure 107, and a plurality of lower left bearings 214 roll along the left bearing rail 215-1. The low-friction rolling contact points created thus mitigate the effects of the physical contact between the carriage 200 and monorail structure 107. It will be appreciated that if the monorail 107 was rotated about the longitudinal axis in the opposite counter-clockwise direction by a similar undefined angle X, the result would be the same, except that the top right bearing would roll along the anti-torsion rail 213, and a plurality of lower right bearings 214 would roll along the bearing rail 215 to mitigate the effects of the contact.

The bearings 214 further serve a primary function of maintaining as close as possible the vertical alignment between the lifting rail pairs 205, 206 and the pre-load rail pairs 203, 204 on both lateral sides of the monorail structure 107. The amount of lateral shift of the carriage 200 relative to the monorail structure 107 is limited to the lateral distance between the bearings 214 on the vertical surfaces of the laterally-extending portions of the undercarriage assemblies 201, 202 and the bearing rails 215 on the adjacent and facing vertical surfaces of the monorail 107 center portion when the vertical axis through the centerline of the monorail structure 107 and levitated carriage 200 is parallel to the gravitational force acting on the apparatus in the unrotated position. However, as can be seen, the magnetic lifting and pre-load forces remain similar on the opposed left and right sides of the monorail structure 107, although the lifting and preloading efficiency of the magnetic elements 209 is reduced.

As was previously described, during use of the exercise machine 500, an exerciser 400 may temporarily apply significant downward force-loading when positioning a part of the exerciser's 400 body on the exercise platform 200*a*. It will be appreciated that this can occur whether the platform 200*a* starts in a substantially horizontal plane as described with respect to FIG. 13 or whether the platform 200*a* starts in a plane laterally rotated about the longitudinal axis of the exercise machine 500 as shown in FIG. 14 and described above.

Referring to FIG. 15, the monorail structure 107 is shown rotated clockwise at an undefined angle X relative to the horizontal plane of the base support structure 100 and the floor, ground surface, or other support surface on which it rests. Without any external force applied to the carriage 200 and/or the platform 200*a*, the condition shown in FIG. 14 would occur. However, when an exerciser mounts the platform 200*a*, a substantial downforce is temporarily applied at or near a lateral side edge of the platform 200*a*, for example substantially at or near the left side of the platform 200*a*. This downward force is indicated by the letter F and the downward-pointing arrow. If the downloading force is sufficient to overcome the magnetic levitation and preload forces, the downward loading has the effect of rotating the carriage 200 and platform 200*a* counter-clockwise relative to the clockwise rotated monorail 107, thus creating mechanical interference at one or more points of contact between the carriage 200 and the monorail structure 107.

As can be readily seen, in this condition the magnetic repelling forces between the upper right (pre-load) rails 204 and the lower left (lifting) rails 206 increase, while the repelling forces between the upper left (pre-load) rails 203 and the lower right (lifting) rails 205 decrease, causing momentary instability. The increased repelling forces are represented by the relatively bolder double-headed arrows and the decreased repelling forces by the relatively less bold double-headed arrows.

The pseudo-levitation system provides a means of temporarily maintaining lateral and vertical stability of the carriage 200 and mitigating the effects of the temporary physical contact between the carriage 200 and monorail 107 at various points until the exerciser 400 more evenly distributes the exerciser's 400 weight on the platform 200*a* of the levitated carriage 200. This is accomplished by the top right bearing 214 rolling along the right edge of the anti-torsion rail 213 of the monorail structure 107, an upper right side bearing 215 rolling along the right bearing rail 215, and a lower left side bearing 214 rolling along the left bearing rail 215.

It will be appreciated that if the downward force were applied at or near the opposite right lateral edge of the platform 200*a*, a condition similar to that shown in FIG. 14 would occur. In that case, the result would be the same as above, except that the top left bearing 214 would roll along the anti-torsion rail 213, and a plurality of lower left bearings 214 would roll along the bearing rail 215-1 to help stabilize the platform 200*a* and carriage 200 and mitigate the effects of the contact. Similarly, it will be appreciated that the result also would be the same if the monorail 107 was rotated counter-clockwise by an angle X and the downward force was applied at or near the right lateral edge of the platform 200*a* except that the top left bearing 214 would roll along the anti-torsion rail 213, an upper left bearing 214 would roll along the left bearing rail 215-1, and a lower right side bearing 214 would roll along the right bearing rail 215.

Figure 16A:
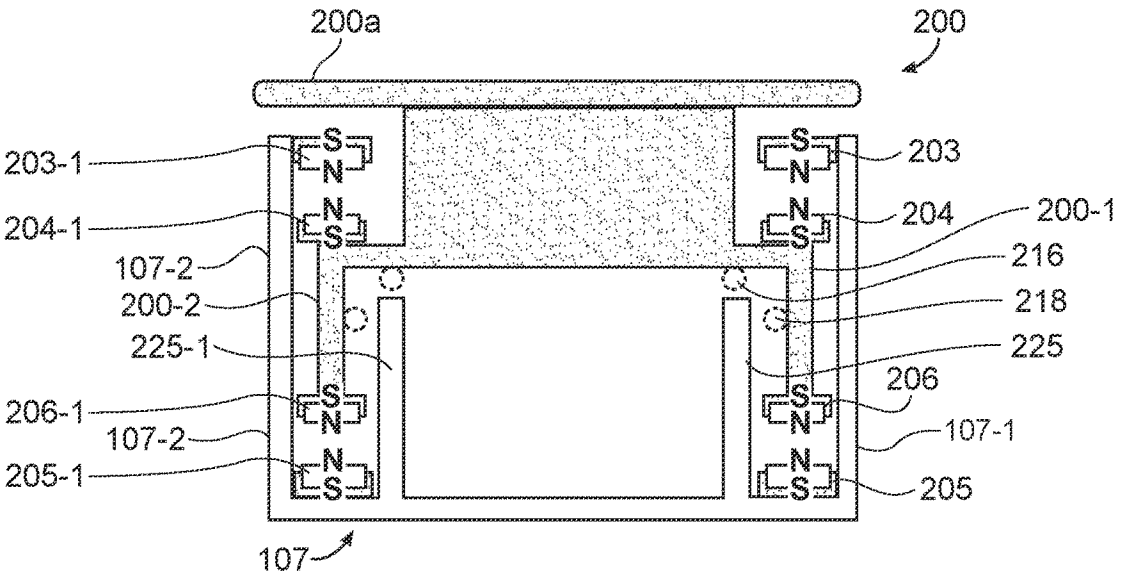
FIG. 16A is a schematic end view of a variation of a magnetically levitated and pseudo-levitated movable carriage and platform of an improved exercise machine in accordance with an example embodiment.
Figure 16B:
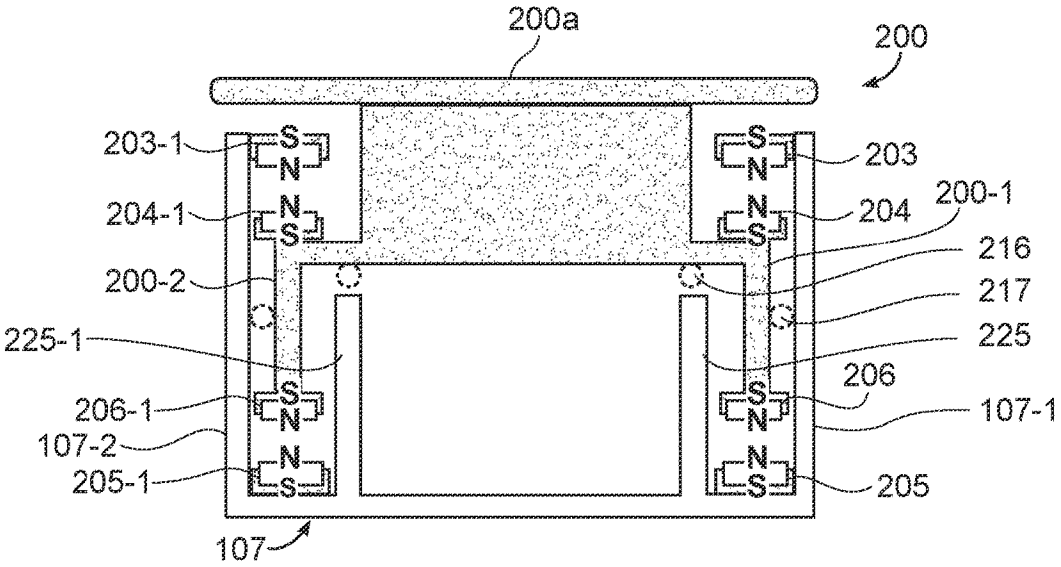
FIG. 16B is a schematic end view of a variation of a magnetically levitated and pseudo-levitated movable carriage and platform of an improved exercise machine in accordance with an example embodiment.

FIGS. 16A and 16B schematically illustrate additional variations of a magnetically and pseudo-levitated exercise carriage 200 and monorail structure 107 of an example exercise machine 500. In these variations, the stationary monorail structure 107 comprises right and left substantially vertical outer magnetic rail supports 107-1, 107-2, and right and left substantially vertical inner load bearing structures 225, 225-1 arranged in a nested U-shape. As in other embodiments previously described, the monorail structure 107 has a longitudinal axis and extends longitudinally substantially the entire length between the front and back ends of the exercise machine 500.

An exercise platform 200*a* is mounted atop the carriage 200, which comprises a pair of right and left substantially vertical carriage rail supports 200-1, 200-2. The carriage rail supports 200-1, 200-2 extend downwardly between the right and left outer magnetic rail supports 107-1, 107-2 and right and left load bearing structures 107-1, 107-2 respectively of the monorail structure 107.

Right and left lower magnetic rails 205, 205-1 of the monorail structure 107 are shown positioned at the lower extents of the right and left outer magnetic rail supports 107-1, 107-2 respectively between the outer magnetic rail supports 107-1, 107-2 and the respective right and left load bearing structures 225. Upper right and left magnetic rails 203, 203-1 of the monorail structure 107 are positioned on the upper extents of the respective right and left outer magnetic rail supports 107-1, 107-2. The right and left lower magnetic rails 205, 205-1 comprise right and left upward facing flux-controlled magnetic elements 209 and the right and left upper magnetic rails 203, 203-1 comprise right and left downward facing flux-controlled magnetic elements 209, with the flux control being provided by magnetic flux concentrators 211. All of the flux-controlled magnetic elements 209 are substantially as previously described in connection with FIGS. 10-12. All of the upper and lower right and left magnetic rails 203, 203-1, 205, 205-1 extend longitudinally and substantially parallel to the longitudinal axis of the monorail structure 107 for at least substantially the entire distance the carriage 200 is intended to travel along the monorail 107.

Right and left lower carriage rails 206, 206-1 are positioned on the carriage 200 at the lower extents of the respective right and left carriage rail supports 200-1, 200-2 in proximity to and facing the right and left lower magnetic rails 205, 205-1, respectively. Right and left upper carriage rails 203, 203-1 are positioned on the carriage 200 at the upper extents of the respective right and left carriage rail supports 200-1, 200-2 in proximity to and facing the right and left upper magnetic rails 204, 204-1, respectively. The right and left lower carriage rails 206, 206-1 comprise right and left downward-facing flux-controlled magnetic elements 209 and the right and left upper magnetic rails 203, 203-1 comprise right and left upward facing flux-controlled magnetic elements 209. All of the flux-controlled magnetic elements 209 are substantially as previously described in connection with FIGS. 10-12. All of the upper and lower right and left carriage rails 204, 204-1, 206, 206-1 extend longitudinally and substantially parallel to the longitudinal centerline of the carriage 200 for substantially the entire length of the carriage 200.

All of the right carriage and magnetic rails 203, 204, 205, 206 may be substantially vertically aligned and all of the left carriage and magnetic rails 203-1, 204-1, 205-1, 206-1 may be substantially vertically aligned. All of the magnetic elements 209 of the right and left carriage and magnetic rails 203, 203-1, 204, 204-1, 205, 205-1, 206, 206-1 may share a common exposed pole (either N or S) such that each pair of adjacent and facing rails 203, 203-1, 204, 204-1, 205, 205-1, 206, 206-1 generates a repelling magnetic force between them. Similar to other embodiments previously described, the adjacent right lower magnetic rail 205 and right lower carriage rail 206 pair and the adjacent left lower magnetic rail 205-1 and left lower carriage rail 206-1 pair provide upward lifting or levitation forces to the carriage 200 and can be referred to as the lifting rails. The adjacent right upper carriage 203 and right upper magnetic rail 204 pair and the adjacent left upper carriage 203-1 and left upper magnetic rail 204-1 pair provide downward pre-load forces to the carriage and can be referred to as the pre-load rails.

Similar to other embodiments previously described and shown, the magnetic elements 209 of the lifting and pre-load rails 203, 203-1, 204, 204-1, 205, 205-1, 206, 206-1 act to levitate and stabilize the carriage 200 and platform 200*a* with respect to the monorail structure 107 without any substantial physical contact. The carriage 200 is thus able to be moved by an exerciser 400 linearly and reciprocally along the monorail structure 107 substantially parallel to the longitudinal axis of the monorail 107 between the front and back ends of the exercise machine 500 without contact and without generating friction or additional resistance forces.

During intermittent periods of downward force overloading on the carriage 200 by an exerciser, vertical stability is maintained by a pseudo-levitation system in a manner similar to that described with respect to the embodiments of FIGS. 13-15. In the embodiment of FIG. 16A, the pseudo-levitation system comprises one or more right and left vertical load bearings 216. The vertical load bearings 216 are substantially the same as the anti-torsion roller or wheel bearings 214 previously described. The right and left vertical load bearings 216 may be mounted on a lower surface of the carriage 200 in vertical alignment with the upper extents of the right and left load bearing structures 225, 225-1 respectively of the monorail 107 and are intended to roll on a top surface of the right and/or left load bearing structures 225, 225-1 as the carriage 200 moves along the monorail 107 depending on the lateral location where the downforce is applied to the platform 200 and/or carriage 200*a*.

The pseudo-levitation system also maintains the stability of the carriage 200 and platform 200*a* in response to forces applied to the platform 200 and/or carriage 200*a* along a transverse axis in the same manner. The pseudo-levitation system comprises one or more right and left medial load bearings 218. The medial load bearings 218 are substantially the same as the anti-torsion roller or wheel bearings 214 previously described. The medial load bearings 218 may be positioned on the inner walls of the substantially vertical right and left carriage rail support structures 200-1, 200-2 that are in proximity to and face the right and left load bearing structures 225, 225-1 respectively. The right and left medial load bearings 218 are designed to roll along the facing substantially vertical surfaces of the right or left load bearing structure 225 as the carriage 200 moves along the monorail 107 depending on the direction from which the transverse force is applied to the platform 200 and/or carriage 200*a*.

The embodiment of FIG. 16B is substantially the same as the embodiment of FIG. 16A except that the pseudo-levitation system comprises one or more right and left lateral load bearings 217 in place of the medial load bearings 218. Again, the lateral load bearings 217 are substantially the same as the anti-torsion roller or wheel bearings 214 previously described. The lateral load bearings 217 may be positioned on the outer substantially vertical surfaces of the right and left carriage rail support structures 200-1, 200-2 that are in proximity to and face the substantially vertical inner walls of the right and left outer magnetic rail supports 107-1, 107-2 respectively of the monorail structure 107. The right and left lateral load bearings 217 are designed to roll along the facing substantially vertical inner surface of the right or left magnetic rail support 107-1, 107-2 as the carriage 200 moves along the monorail 107 depending on the direction from which the transverse force is applied to the platform 200 and/or carriage 200*a*.

Figure 17:
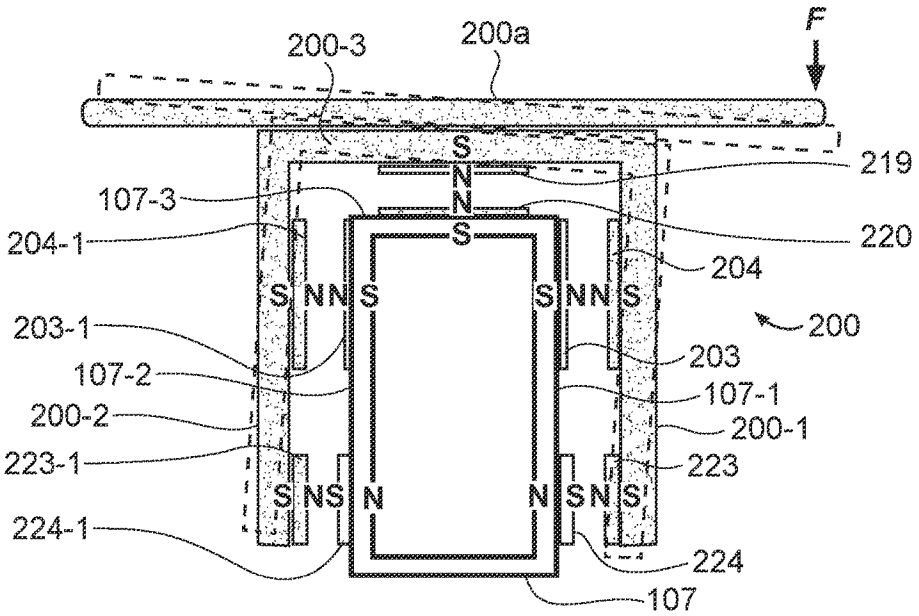
FIG. 17 is a schematic end view of a variation of a magnetically levitated and stabilized movable carriage and platform of an improved exercise machine in accordance with an example embodiment.

FIG. 17 schematically illustrates another variation of a magnetically levitated and stabilized exercise carriage 200 and monorail structure 107 of an example exercise machine 500. In this variation, the carriage 200 comprises a substantially horizontal upper support wall 200-3 on which the exercise platform 200*a* is mounted, and a pair of right and left substantially vertical downward extending carriage rail supports 200-1, 200-2. The stationary monorail structure 107 comprises a monorail body with a substantially horizontal upper support wall 107-3 that is located proximate to and facing the inner surface of the carriage upper support wall 200-3.

The monorail structure 107 further comprises right and left carriage rail support structures 200-1, 200-2 that are substantially vertical, with the outer surface of the right magnetic rail support 107-1 located proximate to and facing the inner surface of the right carriage rail support 200-1 and the outer surface of the left magnetic rail support 107-2 located proximate to and facing the inner surface of the left carriage rail support 200-2. As in other embodiments previously described, the monorail structure 107 has a longitudinal axis and extends longitudinally substantially the entire length between the front and back ends of the exercise machine 500.

A center load rail 220 is positioned on the upper support wall 107-3 of the monorail structure 107, with the center load rail 220 being aligned on the longitudinal center line of the monorail 107 in proximity to and facing the inner surface of the upper support wall 200-3 of the carriage. The center load rail 220 may extend longitudinally and substantially parallel to the longitudinal axis of the monorail structure 107 for at least substantially the entire distance the carriage 200 is intended to travel along the monorail 107. The center load rail 220 may comprise an arrangement of upward facing flux-controlled magnetic elements 209 substantially as previously described in connection with FIGS. 10-12.

A center carriage rail 219 is positioned on the inner surface of the upper support wall 200-3 of the carriage 200, with the center carriage rail 219 being aligned on the longitudinal center line of the carriage 200 in proximity to and facing the center load rail 220 on the outer surface of the upper support wall 107-3 of the monorail structure 107. The center carriage rail 219 may extend longitudinally and substantially parallel to the longitudinal axis of the carriage 200 for substantially the entire length of the carriage 200. The center carriage rail 219 may comprise an arrangement of downward facing flux-controlled magnetic elements 209 substantially as previously described in connection with FIGS. 10-12.

The center load rail 220 and center carriage rail 219 are substantially vertically aligned and directly facing so that their respective magnetic elements 209 similarly are substantially vertically aligned and facing. Also, the magnetic elements 209 of the center load rail and center carriage rail have the same pole exposed in their respective flux concentrators 211, either N or S, so as to generate repelling magnetic forces between the two rails 219, 220. The repelling magnetic forces generated by the center load rail 220 and center carriage rail 219 pair act to lift or levitate the carriage 200 and platform 200*a* relative to the monorail structure 107. This rail 219, 220 pair thus can be referred to as the central levitating rail.

To help laterally stabilize the carriage 200 and prevent it from shifting laterally as it moves along the monorail 107, a pair of right and left upper magnetic rails 203, 203-1 and a corresponding pair of right and left upper carriage rails 204, 204-1 are provided. The pair of right and left upper magnetic rails 203, 203-1 is positioned on the outer surfaces of the right and left magnetic rail supports 107-1, 107-2 respectively of the monorail 107 near their upper extents. The right and left upper magnetic rails 203, 203-1 are positioned laterally aligned with each other at the same vertical elevation on the magnetic rail supports 107-1, 107-2. Both of the right and left upper magnetic rails 203, 203-1 may extend longitudinally and substantially parallel to the longitudinal axis of the monorail for substantially the entire length of the monorail 107 along which the carriage 200 is intended to travel. Each of the right and left upper magnetic rails 107-1, 107-2 may comprise an arrangement of outward facing flux-controlled magnetic elements 209 substantially as previously described in connection with FIGS. 10-12.

The pair of right and left upper carriage rails 204, 204-1 is positioned on the inner surfaces of the right and left carriage rail supports 200-1, 200-2 respectively in proximity to and facing the right and left upper magnetic rails 203, 203-1 respectively. The right and left upper carriage rails 204, 204-1 are positioned laterally aligned with and at the same vertical elevation as the respective right and left magnetic rails 203, 203-1 on the respective right and left magnetic rail supports 107-1, 107-2. Both of the right and left upper carriage rails 204, 204-1 extend longitudinally and substantially parallel to the longitudinal axis of the carriage 200 for substantially the entire length of the carriage 200. Each of the right and left upper carriage rails 204, 204-1 may comprise an arrangement of inward facing flux-controlled magnetic elements 209 substantially as previously described in connection with FIGS. 10-12.

The magnetic elements 209 of the right and left upper carriage rails 204, 204-1 and the magnetic elements 209 of the respective right and left upper magnetic rails 203, 203-1 have the same pole exposed in their respective flux concentrators 211, either N or S, so as to generate repelling magnetic forces between the two rails 203, 204. Accordingly, as the carriage 200 travels linearly along the monorail structure 1007, the pair of right upper carriage and magnetic rails 203, 204 apply an outward force on the inner surface of the right carriage support structure 200-1 and the pair of left upper carriage and magnetic rails 203-1, 204-1 apply an outward force on the inner surface of the left carriage support structure 200-2. The magnetic elements 209 of the rails 203, 204 may be adjusted so that these forces are substantially equal so that acting together they maintain the longitudinal centerline of the carriage 200 substantially aligned with the central longitudinal axis of the monorail 107.

To help stabilize the carriage 200 and platform 200*a* during temporary periods of down force overloading on the carriage by an exerciser, torsional rotation of the carriage 200 is counteracted by a pair of right magnetic and carriage anti-torsion rails 223, 224, and a pair of left magnetic and carriage anti-torsion rails 223-1, 224-1. The right and left magnetic anti-torsion rails 224, 224-1 are positioned laterally aligned with each other and at the same elevation on the outer surfaces of the right and left magnetic rail supports 107-1, 107-2 respectively of the monorail 107 near their lower extents. Both of the right and left magnetic anti-torsion rails 223, 223-1, 224, 224-1 may extend longitudinally and substantially parallel to the longitudinal axis of the monorail 107 for substantially the entire length of the monorail 107 along which the carriage is intended to travel. Each of the right and left magnetic anti-torsion rails 223, 223-1, 224, 224-1 may comprise an arrangement of outward facing flux-controlled magnetic elements 209 substantially as previously described in connection with FIGS. 10-12.

The right and left carriage anti-torsion rails 223, 223-1 are positioned on the inner surfaces of the carriage rail support structures 200-1, 200-2 in proximity to and facing the right and left magnetic torsion rails 224, 224-1 respectively. The right and left carriage anti-torsion rails 223, 223-1 are positioned laterally aligned with and at the same vertical elevation as the respective right and left magnetic anti-torsion rails 224, 224-1 on the respective right and left magnetic rail supports 107-1, 107-2. Both of the right and left carriage anti-torsion rails 223, 223-1 may extend longitudinally and substantially parallel to the longitudinal axis of the carriage 200 for substantially the entire length of the carriage 200. Each of the right and left upper carriage rails 223, 223-1 may comprise an arrangement of inward facing flux-controlled magnetic elements 209 substantially as previously described in connection with FIGS. 10-12.

As the carriage 200 travels linearly along the monorail structure 107, the pair of right carriage and right magnetic anti-torsion rails 223, 224 apply a magnetic force on the inner surface of the right carriage rail support structure 200-1 and the pair of left carriage and left magnetic anti-torsion rails 223-1, 224-1 apply magnetic force on the inner surface of the left carriage rail support structure 200-2. The magnetic elements 209 of the rails 223, 223-1, 224, 224-1 are adjusted so that the magnetic forces applied are substantially equal such that they act together to effectively counteract forces that would induce torsional instability in the carriage 200 and platform 200*a*. The pair of adjacent facing right carriage and magnetic anti-torsion rails 223, 224 and the pair of adjacent facing left carriage and magnetic anti-torsion rails 223-1, 224-1 can be referred to as simply the anti-torsion rails.

The magnetic elements 209 of each of the pairs of anti-torsion rails 223, 223-1, 224, 224-1 are arranged with their opposite poles, either N-S or S-N, exposed in their respective flux concentrators 211 and facing each other so as to generate attractive magnetic forces between the rails 223, 223-1, 224, 224-1. This is because the force of attraction generated by two magnets in close proximity and with their opposite-poles facing is often considered greater than the force of repulsion generated by the same two magnets at the same proximity and oriented with their same poles facing. Thus, it can be seen that if the magnetic elements 209 of the adjacent facing rails 223, 223-1, 224, 224-1 comprising the anti-torsion rails are arranged with opposite poles facing each other, a greater force will be induced and applied to the carriage 200 to counteract torsional rotation of the carriage 200 than if the magnetic elements were arranged with their common poles facing so as to generate repelling magnetic forces between the rails 223, 223-1, 224, 224-1. Further, positioning the anti-torsion rails 223, 223-1, 224, 224-1 at a substantially lower elevation on the substantially vertical surfaces of the right and left magnetic rail support structures 107-1, 107-2 of the monorail 107 than the right and left upper lateral stability rails provides a significantly longer moment arm which assists in further amplifying the stabilizing forces generated by the anti-torsion rails.

Figure 18:
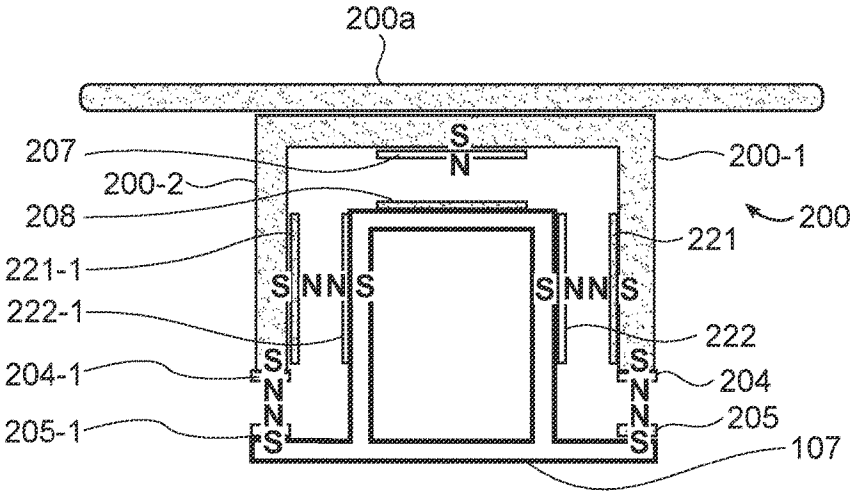
FIG. 18 is a schematic end view of a variation of a magnetically levitated and stabilized movable carriage and platform of an improved exercise machine in accordance with an example embodiment.

FIG. 18 schematically illustrates yet another variation of a magnetically levitated and stabilized exercise carriage 200 and monorail structure 107 of an example exercise machine 500. In this variation, right and left upper carriage rails 204, 204-1 are positioned on the movable carriage 200 at the lower extents of the right and left carriage rail support structures 200-1, 200-2 and corresponding right and left lower magnetic rails 205, 205-1 are positioned on lower surfaces of the stationary monorail structure 107 in proximity to and facing the respective right and left upper carriage rails 204, 204-1.

Each of the upper carriage rails 204, 204-1 and each of the lower magnetic rails 205, 205-1 comprises an arrangement of downward facing flux-controlled magnetic elements 209 which are flux-controlled by, for example, being seated in a flux concentrator 211, substantially as previously described in connection with FIGS. 10-12 with the magnetic elements 209 of the upper carriage rails 204, 204-1 facing downward and the magnetic elements 209 of the lower magnetic rails 205, 205-1 facing upward. The right upper carriage rail 204 and right lower magnetic rail 205 are substantially vertically aligned and the left upper carriage rail 204-1 and left lower magnetic rail 205-1 are substantially vertically aligned.

As with other embodiments previously described, the upper carriage rails 204, 204-1 may extend longitudinally and in parallel with the longitudinal axis of the carriage 200 for substantially the entire length of the carriage 200, and the lower magnetic rails 205, 205-1 may extend longitudinally and in parallel with the longitudinal axis of the monorail 107 for substantially the entire length of the monorail 107 along which the carriage 200 is intended to travel. Also as with other embodiments previously described, the magnetic elements 209 of the vertically-aligned right upper carriage rail 204 and right lower magnetic rail 205 pair and the magnetic elements 209 of the vertically-aligned left upper carriage 204-1 and left lower magnetic rail 205-1 pair are oriented with their common poles (N or S) exposed and facing to generate repelling magnetic forces.

The repelling magnetic forces generated by the left and right rail pairs 204, 204-1, 205, 205-1 are applied to the carriage 200 through the lower extents of the right and left carriage rail support structures 200-1, 200-2 and are operable to levitate the carriage 200 and platform 200*a* mounted atop the carriage 200 relative to the monorail structure 107. These rail pairs 204, 204-1, 205, 205-1 thus constitute the lifting rails.

Lateral stability of the carriage 200 is provided for in essentially the same manner as the embodiment of FIG. 17 by use of right and left pairs of opposed and adjacent lateral load carriage rails 221, 221-1 and lateral load magnetic rails 222, 222-1. Right and left side lateral load carriage rails 221, 221-1 are positioned on the medial surfaces of the right and left carriage rail support structures 200-1, 200-2, and the respective opposed right and left side lateral load magnetic rails 222, 222-1 are positioned on the substantially vertical facing side surfaces of the monorail structure 107.

As with previously described embodiments, the lateral load carriage rails 221, 221-1 may extend longitudinally and in parallel with the longitudinal axis of the carriage 200 for substantially the entire length of the carriage 200, and the lateral load magnetic rails 222, 222-1 may extend longitudinally and in parallel with the longitudinal axis of the monorail 107 for substantially the entire length of the monorail 107 along which the carriage 200 is intended to travel. Also as with other embodiments previously described, the magnetic elements 209 of the opposed and facing lateral load carriage 221, 221-1 and lateral load magnetic rail pairs 222, 222-1 are oriented with their common poles (N or S) exposed and facing to generate repelling magnetic forces. These forces may be arranged to be substantially equal and together act to laterally stabilize the carriage 200 in the manner previously described.

Further, an eddy current brake is provided to induce a resistance against movement of the carriage 200 along the longitudinal axis of the machine 500. The eddy current brake may comprise the combination of an eddy current brake magnet 207 and a non-ferrous braking rail 208. The brake magnet 207 is affixed to the underside of the carriage structure aligned with the longitudinal center line of the carriage 200 and may extend longitudinally for up to substantially the length of the carriage 200 as desired. The braking rail 208 is affixed to the upper surface of the monorail structure 107 aligned with the longitudinal center line of the monorail structure 107 in proximity to and facing the brake magnet 207.

The braking rail 208 may extend longitudinally along the monorail for substantially the entire length of the monorail 107 the carriage is intended to travel along. The braking rail may be constructed of a variety of non-ferrous materials with aluminum being preferred for the reasons previously described. As previously described, the inclusion of the eddy brake helps to stabilize the carriage and platform as they travel along the monorail structure, as well as to dampen vibrations.

Figure 19:
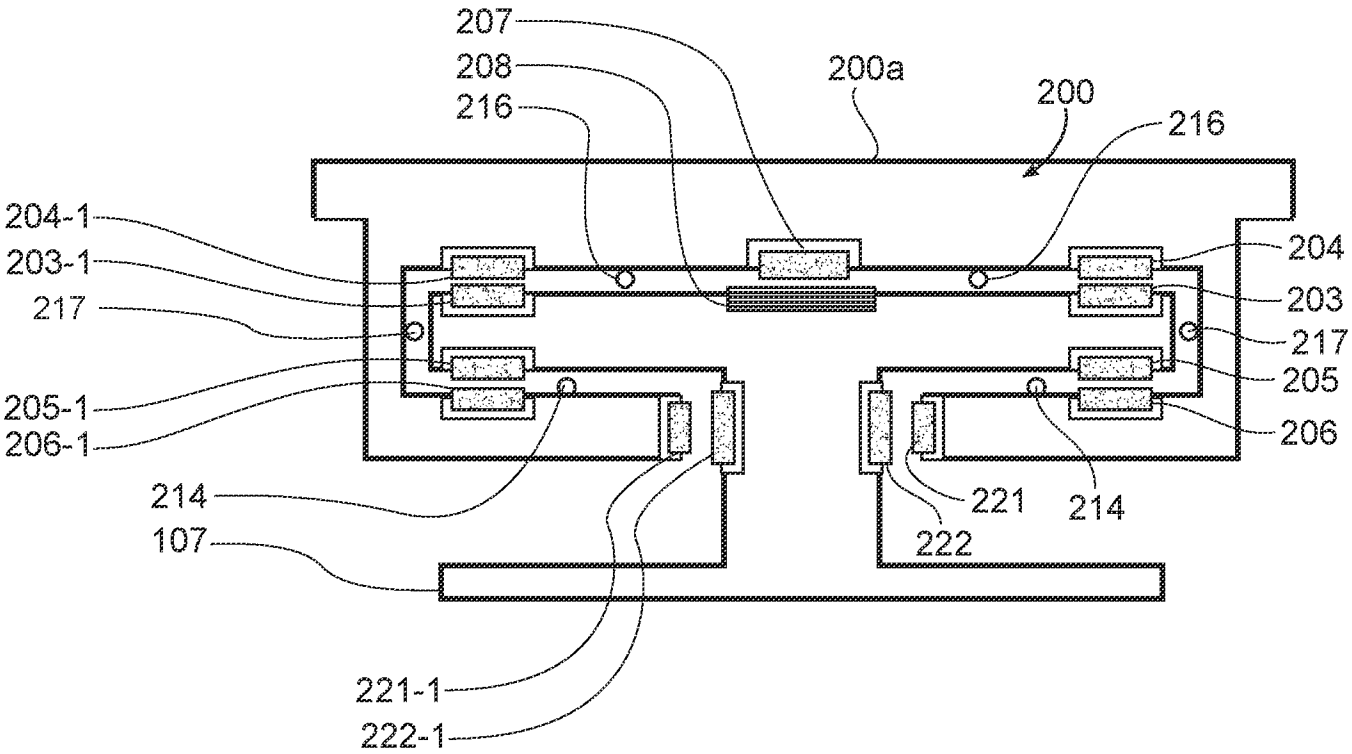
FIG. 19 is a schematic end view of a variation of a magnetically levitated and pseudo-levitated movable carriage and platform of an improved exercise machine in accordance with an example embodiment with an eddy brake incorporated.

FIG. 19 schematically illustrates still another variation of a magnetically levitated, magnetically stabilized, and pseudo-levitated exercise carriage 200 and monorail structure 107 with an eddy brake for an example exercise machine 500. A stationary central monorail structure 107 comprises a T-shaped upper portion with upper and lower surfaces. As with other embodiments, the monorail structure 107 extends longitudinally substantially the entire length of the exercise machine 500 between the front and back ends. The levitated movable carriage 200 has an exercise platform 200*a* and comprises an undercarriage 201, 202 with right and left rotated L-shaped portions that extend downwardly substantially vertically from at or near the right and left lateral edges of the carriage 200 respectively and then turn substantially horizontally and wrap beneath the right and left upper portions of the "T" of the monorail structure 107. Each of the L-shaped portions comprises top, side and underside surfaces that face the surfaces of the monorail structure corresponding to the "T."

The carriage is pre-loaded by the repelling magnetic forces generated by right and left pairs of opposed lower magnetic rails and lower carriage rails 205, 206 and 205-1, 206-1. The right lower magnetic rail and lower carriage rail pair 205, 206 is substantially vertically aligned, in proximity, and facing as is the left lower magnetic rail and lower carriage rail pair 205-1, 206-1. The lower carriage rails 206, 206-1 may extend longitudinally for substantially the length of the carriage 200 in parallel with the longitudinal axis of the carriage 200. The lower magnetic rails 205, 205-1 may extend longitudinally and in parallel with the longitudinal axis of the monorail structure 107 for substantially the entire length of the monorail the carriage is intended to travel. Each of the rails 205, 205-1, 206, 206-1 may an arrangement of flux-controlled magnetic elements 209 substantially as previously described in connection with FIGS. 10-12 with the magnetic elements 209 of the lower carriage rails 206, 206-1 and the opposing lower magnetic rails 205, 205-1 being oriented with opposite poles, N or S, facing to generate magnetic repelling forces. The vertically aligned pairs of opposed lower magnetic rails 205, 205-1 and lower carriage rails 206, 206-1 comprise the pre-load rails.

Levitation of the carriage 200 is provided by the repelling magnetic forces generated by right and left pairs of upper magnetic rails 203, 203-1 and opposed upper carriage rails 204, 204-1. The upper magnetic rails 203, 203-1 are positioned on right and left portions of the upper surface of the T-shaped monorail structure 107, and the opposed upper carriage rails 204, 204-1 are positioned on the undersurface of the undercarriage 201, 202 beneath the platform 200*a*.

The right upper magnetic rail and upper carriage rail pair 203, 204 are substantially vertically aligned, in proximity and facing as are the left upper magnetic rail and upper carriage rail pair 203-1, 204-1. The upper carriage rails 204, 204-1 may extend longitudinally for substantially the length of the carriage in parallel with the longitudinal axis of the carriage 200. The upper magnetic 203, 203-1 rails may extend longitudinally and in parallel with the longitudinal axis of the monorail structure 107 for substantially the entire length of the monorail 107 the carriage 200 is intended to travel. Each of the rails 203, 203-1, 204, 204-1 may comprise an arrangement of flux-controlled magnetic elements 209 substantially as previously described in connection with FIGS. 10-12 with the magnetic elements 209 of the upper carriage rails 204, 204-1 and the opposing upper magnetic rails 203, 203-1 being oriented with opposite poles, N or S, facing to generate magnetic repelling forces. The vertically aligned pairs of opposed upper magnetic rails 203, 203-1 and upper carriage rails 204, 204-1 comprise the lifting rails.

Lateral stability is provided by right and left pairs of lateral load magnetic rails 222, 222-1 and lateral load carriage rails 221, 221-1. The right and left lateral load magnetic rails 222, 222-1 are positioned on substantially vertical surfaces of the T-shaped monorail structure 107 that are on opposite right and left lateral sides of the monorail 107, and the opposed lateral load carriage rails 221, 221-1 are positioned on substantially vertical medial surfaces of the lower portion of the T-shaped undercarriage 201, 202 proximate to and facing the surfaces of the monorail structure 107 on which the corresponding lateral load magnetic rails 222, 222-1 are positioned.

As with other embodiments, the lateral load magnetic rail 222, 222-1 and lateral load carriage rail 221, 221-1 of each pair are directly aligned and comprise an arrangement of flux-controlled magnetic elements 209 substantially as previously described in connection with FIGS. 10-12, with the magnetic elements 209 of the upper carriage rails 204, 204-1 and the opposing upper magnetic rails 203, 203-1 oriented with opposite poles, N or S, facing to generate magnetic repelling forces. Also as in other embodiments, the lateral load magnetic rails 222, 222-1 may extend longitudinally and in parallel with the longitudinal axis of the carriage 200 for substantially the entire length of the carriage 200. The lateral load magnetic rails 222, 222-1 may extend longitudinally and in parallel with the longitudinal axis of the monorail structure 107 for substantially the entire length of the monorail 107 that the carriage 200 is intended to travel.

Further, a pseudo-levitation system prevents temporary overloading on the carriage 200 that may otherwise not be adequately resisted solely by the magnetic elements 209 described above. The pseudo-levitation system comprises a plurality of vertical load bearings 216 and a plurality of lateral load bearings 217 to counter vertical and lateral overloading on the carriage 200, and a plurality of anti-torsion bearings 214 that limit uplift on the carriage 200 in response to a downward force exerted on the side of the carriage 200 opposite to the anti-torsion bearings 214.

Inductive braking is also provided as a means of inducing a resistance force against the carriage 200 as may be preferred for resistance training or exercising. The brake comprises one or more eddy current brake magnets 207 affixed to the underside of the carriage 200 structure aligned with the longitudinal centerline of the carriage 200, and an opposed non-ferrous braking rail 208 affixed to the upper surface of the monorail structure 107 in alignment with and facing the brake magnet(s). It should be noted that the location of the eddy current brake is not limited to the center top portion of the monorail structure 107, and is not limited to one braking rail 208 and opposed magnets 207. A plurality of brakes may be positioned on any monorail structure surface 107 that faces an opposed surface of the levitated carriage 200, so long as the eddy current brake magnet flux and non-ferrous rail do not interfere with the rails used for levitation, preloading or lateral stability.

It should be noted that in connection with the example embodiment of FIG. 19 as described above and also in connection with all of the example embodiments described herein the opposed magnetic and carriage rails comprising the lifting or levitation rails may comprise magnetic elements 209 with magnetic flux concentrators 211 arranged as described in connection with FIGS. 10-11. Further, in every instance in which it is described that the magnetic elements 209 of opposing rails are oriented or arranged with the same poles facing, or with opposite poles facing, the reverse orientation may be substituted, which substitution is intended to be encompassed within the scope of the embodiments described herein. However, the same orientation of magnetic poles (opposite or same) should be consistently used for all lifting/levitation rails in an embodiment, for all pre-load rails in an embodiment, and for all lifting/levitation and pre-load rails when both are used together in an embodiment. Similarly, the same orientation should be consistently used for all lateral load rails used in an embodiment.

E. Operation of Preferred Embodiment

In use, an exerciser 400 or instructor may first activate the front and/or back actuators 101, 102, 104, 105 to adjust the vertical positions of the front and/or back ends and the inclination of the exercise machine 500 as desired or appropriate for an exercise or exercises to be performed. An exerciser 400 or instructor may also select and connect one or more resistance springs 116 to the movable platform 200*a* to apply a desired amount of resistance force to the movable platform 200*a*.

The exerciser 400 may then mount the exercise machine 500 and position the exerciser's 400 body appropriately for the exercise(s) to be performed. Alternatively, an exerciser 400 may mount the exercise machine 500 prior to adjusting the elevations of the front and back ends of the machine 500, the machine inclination, and the desired biasing force. Obviously, however, caution should be taken in adjusting the exercise machine 500 while an exerciser 400 is mounted thereon in order to avoid falling as the exercise machine 500 is in motion.

With the exercise machine 500 adjusted to provide an exercise plane 300 of a desired elevation, inclination, and rotation and to provide a desired resistance biasing force against the movable exercise platform 200*a*, the exerciser 400 may perform any desired exercises targeting various muscles and muscle groups. By way of example, an exerciser 400 may set up the machine 500 with the front end of the exercise machine 500 slightly inclined relative to the back end of the machine 500 or vice versa to perform one type of exercise. The exerciser 400 may then kneel on the movable platform 200*a* that is mounted on the levitated carriage 200 of the machine 500 while leaning forward or rearward and grasping the stationary front or back end platform 103, 106 or one or more of the front or back handles 108, 109, 110, 111.

Prior to the exerciser 400 mounting the machine 500 and kneeling on the movable platform 200*a*, the magnetic levitation rails, magnetic pre-load rails, and pseudo-levitation elements that are mounted on various opposing surfaces of the elevated carriage 200 and stationary rail structure 107 of the machine 500 act to maintain the levitated carriage 200 and platform 200*a* in a stable condition and at a suitable elevation to be mounted. As the exerciser 400 mounts the machine 500 and begins to kneel on the movable platform 200*a*, the exerciser 400 may impart downward and/or lateral forces to the levitated carriage 200 through the movable platform 200*a*. If these forces are sufficient to overcome the magnetic levitation and pre-load forces on the carriage 200 such that the carriage 200 and platform 200*a* could become unstable, the pseudo-levitation elements of the machine 500 become operative to temporarily assist in stabilizing the carriage 200 and platform 200*a* until the exerciser 400 adjusts to more uniformly distribute the exerciser's 400 weight on the platform 200*a*.

When force is applied to the movable carriage 200 and platform 200*a*, the magnetic rails 203, 203-1, 205, 205-1 and the carriage rails 204, 204-1, 206, 206-1 will maintain levitation between the movable carriage 200 and the monorail 107. The first side of the carriage 200 is maintained in a levitated state by the magnetic fluxes of the first upper magnetic rail 203 and first upper carriage rail 204 and the first lower magnetic rail 205 and first lower carriage rail 206. The second side of the carriage 200 is maintained in a levitated state by the magnetic fluxes of the second upper magnetic rail 203-1 and second upper carriage rail 204-1 and the second lower magnetic rail 205-1 and second lower carriage rail 206-1.

Occasionally, a downward force applied to a first side of the carriage 200 may be greater than a downward force applied to a second side of the carriage 200, or vice versa. In such situations, the anti-torsion bearings 214 or rollers will maintain pseudo-levitation by contacting and moving against an opposing anti-torsion rail 213 such as shown in FIGS. 13-15. The anti-torsion bearings 214 prevent frictional force being applied to slow movement of the carriage 200 along the track 119 in such situations where the carriage 200 may become tilted to one side or the other.

The eddy current brakes may also be adjusted to increase or decrease an induced braking force. The first eddy current brake magnet 207 may be adjusted through tightening or loosening of an adjustment bolt 304. The second eddy current brake magnet 207 may similarly be adjusted through tightening or loosening of an adjustment bolt 304. Tightening the adjustment bolts 304 moves the eddy current brake magnets 207, 207-1 towards the braking rail 208, thus increasing induced braking force, and loosening the adjustment bolts 304 moves the eddy current brake magnets 207, 207-1 away from the braking rail 208, thus decreasing induced braking force.

After the exerciser 400 has mounted the machine 500 and adjusted the exerciser's 400 weight on the platform 200*a*, the exerciser 400 may then extend or contract the lower portion of the exerciser's 400 body in a direction away from the front or back end of the machine 500 and toward the opposite end of the machine 500 while continuing to grasp the stationary platform or handles. This exercise movement causes the movable platform 200*a* to move linearly toward the back end of the machine 500 along the stationary rail structure 107 and against the pre-selected resistance force. Because the carriage 200 on which the movable platform 200*a* is mounted is levitated above the rail structure 107, there is substantially no physical contact between the carriage 200 and the rail structure 107 during normal use and thus no additional friction force or additional resistance force added to the exercise beyond the preset resistance force. However, depending on the selected elevation and inclination settings and the exerciser's 400 position on the machine 500, a portion of the exerciser's 400 weight may also contribute additional force that the exerciser 400 must overcome via muscle exertion to move the movable platform 200*a* toward the back end of the machine 500.

As the exerciser 400 causes the movable platform 200*a* to move along the rail based on the exerciser's 400 muscular exertion, the magnetic lateral load rail elements arranged on various opposed lateral surfaces of the carriage 200 and rail structure 107 generate magnetic forces that help keep the carriage 200 aligned with the rail structure resist and minimize any lateral or uplift movement of the movable platform 200*a* as it moves. Also as the carriage 200 moves linearly relative to the stationary rail structure, eddy brake components on opposing surfaces of the carriage 200 and stationary rail structure further stabilize the carriage 200 and platform 200*a* and help minimize vibrations.

When the exerciser 400 has moved the platform 200*a* as far toward the back end of the machine 500 as desired for the particular exercise, the exerciser 400 may then reverse the movement in order to return the movable platform 200*a* to the initial position near the front end of the machine 500. The exerciser 400 may repeat the foregoing movements as many times as desired. It is noted that the inclination settings of the exercise machine 500 and the resistance to the exerciser's 400 movement provided by the resistance springs 116 may be adjusted at any time to increase or decrease the muscle exertion required by the exerciser 400 to perform the exercise.

It will be noted that as the exerciser 400 dismounts from the movable platform 200*a*, the exerciser 400 may once again impart vertical and transverse forces to the levitated carriage 200 that may overcome the magnetic levitation and pre-load forces and cause instability. Again, in that instance the pseudo-levitation elements of the machine 500 become active and act to minimize the instability under the overload forces are removed.

While one example of a useful exercise has been provided above, it is not intended that the exercise machine 500 as described herein be limited to performing any particular exercises. To the contrary, it will be appreciated that a wide variety of useful exercises may be performed using the exercise machine 500 described herein.

Unless otherwise defined, all technical and scientific terms used herein have the same meaning as commonly understood by one of ordinary skill in the art to which this invention belongs. Although methods and materials similar to or equivalent to those described herein can be used in the practice or testing of the safety cover, suitable methods and materials are described above. All publications, patent applications, patents, and other references mentioned herein are incorporated by reference in their entirety to the extent allowed by applicable law and regulations. The example exercise machine 500 described herein may be embodied in other specific forms without departing from the spirit or essential attributes thereof, and it is therefore desired that the present embodiments be considered in all respects as illustrative and not restrictive. Further, any headings utilized within the description are for convenience only and have no legal or limiting effect.

What is claimed is:

1. An exercise machine, comprising:

at least one rail;

a carriage adapted to move along the at least one rail;

a first upper magnetic rail connected to the at least one rail;

a first upper carriage magnet connected to the carriage, wherein the first upper carriage magnet is aligned with the first upper magnetic rail such that a force is imparted between the first upper carriage magnet and the first upper magnetic rail;

a second upper magnetic rail connected to the at least one rail;

a second upper carriage magnet connected to the carriage, wherein the second upper carriage magnet is aligned with the second upper magnetic rail such that a force is imparted between the second upper carriage magnet and the second upper magnetic rail;

a first lower magnetic rail connected to the at least one rail;

a first lower carriage magnet connected to the carriage, wherein the first lower carriage magnet is aligned with the first lower magnetic rail such that a force is imparted between the first lower carriage magnet and the first lower magnetic rail;

a second lower magnetic rail connected to the at least one rail; and a second lower carriage magnet connected to the carriage, wherein the second lower carriage magnet is aligned with the second lower magnetic rail such that a force is imparted between the second lower carriage magnet and the second lower magnetic rail.

2. The exercise machine of claim 1, wherein the first upper carriage magnet, the second upper carriage magnet, the first lower carriage magnet, and the second lower carriage magnet each comprise a magnetic flux concentrator.

3. The exercise machine of claim 1, wherein the first upper magnetic rail, the second upper magnetic rail, the first lower magnetic rail, and the second lower magnetic rail each comprise one or more magnetic elements.

4. The exercise machine of claim 3, wherein the one or more magnetic elements each comprise a magnetic flux concentrator.

5. The exercise machine of claim 1, wherein the carriage comprises a first undercarriage and a second undercarriage, wherein the first upper carriage magnet and the first lower carriage magnet are each connected to the first undercarriage, and wherein the second upper carriage magnet and the second lower carriage magnet are each connected to the second undercarriage.

6. The exercise machine of claim 5, wherein the first undercarriage extends between the first upper magnetic rail and the first lower magnetic rail such that the first upper carriage magnet faces the first upper magnetic rail and the first lower carriage magnet faces the first lower magnetic rail, and wherein the second undercarriage extends between the second upper magnetic rail and the second lower magnetic rail such that the second upper carriage magnet faces the second upper magnetic rail and the second lower carriage magnet faces the second lower magnetic rail.

7. The exercise machine of claim 1, wherein the first upper magnetic rail and the first lower magnetic rail are each on a first side of the at least one rail and the second upper magnetic rail and the second lower magnetic rail are each on a second side of the at least one rail.

8. The exercise machine of claim 1, wherein a first side of the at least one rail includes a first braking rail, wherein the carriage comprises a first brake magnet facing the first braking rail.

9. The exercise machine of claim 8, wherein a second side of the at least one rail includes a second braking rail, wherein the carriage comprises a second brake magnet facing the second braking rail.

10. The exercise machine of claim 9, wherein the first braking rail and the second braking rail each comprise a non-ferrous material.

11. The exercise machine of claim 9, wherein the first braking rail and the second braking rail are each adjustable with respect to the carriage.

12. The exercise machine of claim 9, wherein the first braking rail is flux concentrated by a first flux concentrator and the second braking rail is flux concentrated by a second flux concentrator.

13. The exercise machine of claim 12, wherein the first flux concentrator and the second flux concentrator are each comprised of a magnetodielectric material.

14. The exercise machine of claim 1, wherein the at least one rail is comprised of a monorail.

15. An exercise machine, comprising:

at least one rail;

a carriage adapted to move along the at least one rail;

a first upper magnetic rail connected to the at least one rail;

a first upper carriage magnet connected to the carriage, wherein the first upper carriage magnet is aligned with the first upper magnetic rail such that a force is imparted between the first upper carriage magnet and the first upper magnetic rail;

a second upper magnetic rail connected to the at least one rail;

a second upper carriage magnet connected to the carriage, wherein the second upper carriage magnet is aligned with the second upper magnetic rail such that a force is imparted between the second upper carriage magnet and the second upper magnetic rail;

a first lower magnetic rail connected to the at least one rail;

a first lower carriage magnet connected to the carriage, wherein the first lower carriage magnet is aligned with the first lower magnetic rail such that a force is imparted between the first lower carriage magnet and the first lower magnetic rail;

a second lower magnetic rail connected to the at least one rail; and a second lower carriage magnet connected to the carriage, wherein the second lower carriage magnet is aligned with the second lower magnetic rail such that a force is imparted between the second lower carriage magnet and the second lower magnetic rail;

wherein the carriage comprises a first undercarriage and a second undercarriage, wherein the first upper carriage magnet and the first lower carriage magnet are each connected to the first undercarriage, and wherein the second upper carriage magnet and the second lower carriage magnet are each connected to the second undercarriage;

wherein the first upper magnetic rail and the first lower magnetic rail are each on a first side of the at least one rail and the second upper magnetic rail and the second lower magnetic rail are each on a second side of the at least one rail.

16. The exercise machine of claim 15, wherein the first upper carriage magnet, the second upper carriage magnet, the first lower carriage magnet, and the second lower carriage magnet each comprise a magnetic flux concentrator.

17. The exercise machine of claim 15, wherein the first upper magnetic rail, the second upper magnetic rail, the first lower magnetic rail, and the second lower magnetic rail each comprise one or more magnetic elements.

18. The exercise machine of claim 17, wherein the one or more magnetic elements each comprise a magnetic flux concentrator.

19. The exercise machine of claim 15, wherein the first undercarriage extends between the first upper magnetic rail and the first lower magnetic rail such that the first upper carriage magnet faces the first upper magnetic rail and the first lower carriage magnet faces the first lower magnetic rail, and wherein the second undercarriage extends between the second upper magnetic rail and the second lower magnetic rail such that the second upper carriage magnet faces the second upper magnetic rail and the second lower carriage magnet faces the second lower magnetic rail.

20. An exercise machine, comprising:

at least one rail;

a carriage adapted to move along the at least one rail;

a first upper magnetic rail connected to the at least one rail;

a first upper carriage magnet connected to the carriage, wherein the first upper carriage magnet is aligned with the first upper magnetic rail such that a force is imparted between the first upper carriage magnet and the first upper magnetic rail;

a first lower magnetic rail connected to the at least one rail;

a first lower carriage magnet connected to the carriage, wherein the first lower carriage magnet is aligned with the first lower magnetic rail such that a force is imparted between the first lower carriage magnet and the first lower magnetic rail;

wherein the first upper carriage magnet and the first lower carriage magnet each comprise a magnetic flux concentrator; and a first braking rail connected to a first side of the at least one rail, wherein the carriage comprises a first brake magnet facing the first braking rail.

* * * * *